US009398783B2

(12) United States Patent
Nimmons et al.

(10) Patent No.: US 9,398,783 B2
(45) Date of Patent: Jul. 26, 2016

(54) HELMET WITH SHELL HAVING RAISED CENTRAL CHANNEL AND EAR HOLES WITH ABUTTING SLOPPED BANKS

(71) Applicant: Kranos IP Corporation, Litchfield, IL (US)

(72) Inventors: Kenneth W. Nimmons, Litchfield, IL (US); David Rogers, Boston, MA (US); Duco Noordzij, Roxbury, MA (US); Eduard Milea, Allston, MA (US); Larry Maddux, Salem, IL (US); Ray Drake, Salem, IL (US)

(73) Assignee: KRANOS IP CORPORATION, Litchfield, IL (US)

( * ) Notice: Subject to any disclaimer, the term of this patent is extended or adjusted under 35 U.S.C. 154(b) by 476 days.

(21) Appl. No.: 13/934,816

(22) Filed: Jul. 3, 2013

(65) Prior Publication Data

US 2013/0333098 A1 Dec. 19, 2013

Related U.S. Application Data

(60) Continuation of application No. 13/469,981, filed on May 11, 2012, now Pat. No. 8,499,366, which is a division of application No. 11/981,171, filed on Oct. 31, 2007, now Pat. No. 8,209,784.

(51) Int. Cl.
*A42B 3/16* (2006.01)
*A42B 3/20* (2006.01)

(52) U.S. Cl.
CPC ... *A42B 3/16* (2013.01); *A42B 3/20* (2013.01); *A42B 3/163* (2013.01)

(58) Field of Classification Search
CPC ..... A42B 3/00; A42B 3/04; A42B 3/163; A42B 3/18; A42B 3/16; A42B 3/166
USPC ..... 2/424, 425
See application file for complete search history.

(56) References Cited

U.S. PATENT DOCUMENTS 1,060,220 A 4/1913 White
1,203,564 A 11/1916 April (Continued)

FOREIGN PATENT DOCUMENTS

CH 692011 1/2002
DE 8321097 10/1983

(Continued)

OTHER PUBLICATIONS

Expert Report of Mr. Rovani filed Dec. 15, 2009, *Riddell, Inc.* v. *Schutt Sports, Inc.*; U.S. District Court for the W. D. of Wisconsin; 08-cv-711.

(Continued)

*Primary Examiner* — Christopher Harmon
(74) *Attorney, Agent, or Firm* — Notaro, Michalos & Zaccaria P.C.

(57) ABSTRACT

A football helmet has a shell with a top portion having a raised central channel at least at one of a front area and a top area of the top portion of the shell, with a plurality of elongated vent openings on each side of the channel, the vent openings being spaced from each other on each side of the channel, from front to back, along the helmet shell, the sides of the helmet having earholes and sloped banks abutting the earholes in a wedge configuration.

10 Claims, 18 Drawing Sheets

(56) References Cited

U.S. PATENT DOCUMENTS 1,262,818 A 4/1918 McGill
1,449,183 A 3/1923 Johnstone
1,522,952 A 1/1925 Goldsmith
1,655,007 A 1/1928 Boettge
1,691,202 A 11/1928 Van
1,705,879 A 3/1929 Rodgers
1,868,926 A 7/1932 Tatore
1,892,943 A 1/1933 Geyer
2,140,716 A 12/1938 Pryale
2,250,275 A 7/1941 Riddell
2,296,335 A 9/1942 Brady
2,354,840 A 8/1944 Seletz
2,570,182 A 10/1951 Daly et al.
2,688,747 A 9/1954 Marx
2,758,304 A 8/1956 McGowan
2,768,380 A 10/1956 Golomb
2,785,405 A 3/1957 Snyder
D180,239 S 5/1957 McMurry
2,850,740 A 9/1958 Adams
2,861,272 A 11/1958 Stuart
2,867,811 A 1/1959 Jones
2,904,645 A 9/1959 Saries
2,969,546 A 1/1961 Morgan, Jr.
2,985,883 A 5/1961 Marietta
2,986,739 A 6/1961 Rozzi
3,039,108 A 6/1962 Lohrenz
3,113,318 A 12/1963 Marietta
3,166,761 A 1/1965 Strohm
3,167,783 A 2/1965 Wolfe
3,186,004 A 6/1965 Carlini
3,187,342 A 6/1965 Aileo
3,216,023 A 11/1965 Morgan
3,263,236 A 8/1966 Humphrey
3,274,613 A 9/1966 Sowle
3,327,313 A 6/1967 Pukish
D212,582 S 11/1968 Feldmann et al.
3,447,162 A 6/1969 Aileo
3,462,763 A 8/1969 Schneider et al.
3,548,409 A 12/1970 Aileo
3,548,410 A 12/1970 Parker
3,568,210 A 3/1971 Marietta
3,609,764 A 10/1971 Morgan
3,619,813 A 11/1971 Marchello
3,713,640 A 1/1973 Margan
3,761,959 A 10/1973 Dunning
3,783,450 A 1/1974 O'Connor
3,787,895 A 1/1974 Belvedere
3,793,241 A 2/1974 Kyle et al.
D230,911 S 3/1974 Isps, Jr.
3,818,508 A 6/1974 Lammers et al.
3,854,146 A 12/1974 Dunning
D234,549 S 3/1975 Bell et al.
3,882,547 A 5/1975 Morgan
3,897,597 A 8/1975 Kasper
3,897,598 A 8/1975 Bednarczuk et al.
3,916,446 A 11/1975 Gooding
3,934,271 A 1/1976 Rhee
3,994,020 A 11/1976 Villari
3,994,021 A 11/1976 Villari et al.
3,994,022 A 11/1976 Villari et al.
4,023,213 A 5/1977 Rovani
4,028,743 A 6/1977 Christensen
4,044,400 A 8/1977 Lewicki
4,060,855 A 12/1977 Rappleyea
4,075,714 A 2/1978 Ryder et al.
4,086,664 A * 5/1978 Humphrey ..... A42B 3/20 2/9
4,101,983 A 7/1978 Dera et al.
D256,851 S 9/1980 Knadle et al.
4,233,687 A 11/1980 Lancellotti
4,272,853 A 6/1981 Schuessler
4,279,038 A 7/1981 Bruckner et al.
4,287,613 A 9/1981 Schulz
D267,287 S 12/1982 Gooding
4,363,140 A 12/1982 Correale
4,370,759 A 2/1983 Zide
4,390,995 A 7/1983 Walck
4,398,306 A 8/1983 Gooding
4,404,690 A 9/1983 Farquharson
D271,249 S 11/1983 Farquharson
D271,347 S 11/1983 Bourque
4,461,044 A 7/1984 Reiterman
4,475,248 A 10/1984 L'Abbe et al.
4,477,929 A 10/1984 Mattsson
4,633,531 A 1/1987 Nimmons
4,646,368 A 3/1987 Infusino et al.
4,651,356 A 3/1987 Zide
4,677,694 A 7/1987 Crow
4,692,947 A 9/1987 Black et al.
4,706,305 A 11/1987 Cho
4,741,054 A 5/1988 Mattes
4,744,107 A 5/1988 Fohl
4,774,729 A 10/1988 Coates et al.
4,794,652 A 1/1989 Piech von Planta et al.
4,808,469 A 2/1989 Hiles
4,831,668 A 5/1989 Schulz
4,837,866 A 6/1989 Rector et al.
4,853,980 A 8/1989 Zarotti
4,866,792 A 9/1989 Arai
4,885,806 A 12/1989 Heller
4,903,346 A 2/1990 Reddemann et al.
4,916,759 A 4/1990 Arai
D309,512 S 7/1990 Crow
4,947,490 A 8/1990 Hayden
5,014,365 A 5/1991 Schulz
5,035,009 A 7/1991 Wingo, Jr. et al.
5,083,321 A 1/1992 Davidsson
5,093,936 A 3/1992 Copeland
5,093,939 A 3/1992 Noyerie et al.
5,101,517 A 4/1992 Douglas
5,129,108 A 7/1992 Copeland
5,136,728 A 8/1992 Kamata
5,142,700 A 8/1992 Reed
D332,507 S 1/1993 Anderson et al.
5,175,889 A 1/1993 Infusino
5,177,816 A 1/1993 Schmidt et al.
5,263,203 A 11/1993 Kraemer et al.
5,263,204 A 11/1993 Butsch
5,267,353 A 12/1993 Milligan
5,293,649 A 3/1994 Corpus
RE34,699 E 8/1994 Copeland
D350,710 S 9/1994 Keiffer
5,347,660 A 9/1994 Zide et al.
D357,555 S 4/1995 Brueckner
5,418,257 A 5/1995 Weisman
5,461,730 A 10/1995 Carrington
D364,487 S 11/1995 Tutton et al.
5,502,843 A 4/1996 Strickland
5,539,936 A 7/1996 Thomas
5,553,330 A 9/1996 Carveth
5,555,567 A 9/1996 Corpus
D378,236 S 2/1997 Zanotto et al.
D378,624 S 3/1997 Chartrand
D382,671 S 8/1997 Shewchenko
D383,953 S 9/1997 DeFilippo
5,666,670 A 9/1997 Ryan et al.
5,675,875 A 10/1997 Servatius
5,713,082 A 2/1998 Bassette et al.
5,724,681 A 3/1998 Sykes
5,732,414 A 3/1998 Monica
5,737,770 A 4/1998 Chen
5,790,988 A 8/1998 Guadagnino, Jr. et al.
5,794,274 A 8/1998 Kraemer
5,799,337 A * 9/1998 Brown ..... A42B 3/20 2/421
D406,399 S 3/1999 Hohdorf
5,883,145 A 3/1999 Hurley et al.
D408,236 S 4/1999 Rennick
5,915,537 A 6/1999 Dallas et al.
5,930,840 A 8/1999 Arai
5,938,878 A 8/1999 Hurley et al.
5,946,735 A 9/1999 Bayes
5,953,761 A 9/1999 Jurga et al.
5,956,777 A 9/1999 Popovich

(56) References Cited

U.S. PATENT DOCUMENTS

| | | | | |
|---|---|---|---|---|
| 5,963,990 | A | 10/1999 | White | |
| 5,966,744 | A | 10/1999 | Smith, Jr. | |
| 6,047,400 | A | 4/2000 | Spencer | |
| 6,054,005 | A | 4/2000 | Hurley et al. | |
| 6,070,271 | A | 6/2000 | Williams | |
| 6,073,271 | A | 6/2000 | Alexander et al. | |
| 6,079,053 | A | 6/2000 | Clover et al. | |
| 6,081,932 | A | 7/2000 | Kraemer | |
| 6,101,636 | A | 8/2000 | Williams | |
| 6,128,786 | A | 10/2000 | Maddux et al. | |
| 6,138,284 | A | 10/2000 | Arai | |
| 6,189,156 | B1 | 2/2001 | Loiars | |
| 6,199,219 | B1 | 3/2001 | Silken | |
| 6,219,850 | B1 | 4/2001 | Halstead et al. | |
| 6,226,801 | B1 | 5/2001 | Alexander et al. | |
| D445,962 | S | 7/2001 | Brignone et al. | |
| 6,256,798 | B1 | 7/2001 | Egolf | |
| 6,272,692 | B1 | 8/2001 | Abraham | |
| D448,526 | S | 9/2001 | Brignone et al. | |
| 6,282,726 | B1 | 9/2001 | Noyerie et al. | |
| D448,890 | S | 10/2001 | Brignone et al. | |
| 6,298,483 | B1 | 10/2001 | Schiebl et al. | |
| 6,298,497 | B1 | 10/2001 | Chartrand | |
| 6,324,701 | B1 | 12/2001 | Alexander | |
| D453,399 | S | 2/2002 | Racine | |
| 6,360,376 | B1 | 3/2002 | Carrington | |
| 6,370,699 | B1 | 4/2002 | Halstead et al. | |
| D459,032 | S | 6/2002 | Gatellet | |
| D459,554 | S | 6/2002 | Gatellet | |
| D459,555 | S | 6/2002 | Gatellet | |
| 6,438,762 | B1 | 8/2002 | Jenkins | |
| 6,438,763 | B2 | 8/2002 | Guay et al. | |
| D465,067 | S * | 10/2002 | Ide | D29/106 |
| 6,481,024 | B1 | 11/2002 | Grant | |
| D466,651 | S * | 12/2002 | Halstead | D29/106 |
| D475,486 | S | 6/2003 | Ide et al. | |
| 6,691,324 | B1 * | 2/2004 | Nakamura | A42B 3/00 2/412 |
| D495,838 | S | 9/2004 | Arai | |
| 6,826,509 | B2 | 11/2004 | Crisco, III et al. | |
| 6,865,752 | B2 | 3/2005 | Udelhofen et al. | |
| 6,883,183 | B2 | 4/2005 | Morrow et al. | |
| 6,934,971 | B2 | 8/2005 | Ide et al. | |
| D509,928 | S | 9/2005 | Barnoski | |
| D512,534 | S * | 12/2005 | Maddux | D29/106 |
| 6,983,488 | B2 | 1/2006 | Foote et al. | |
| 6,996,856 | B2 | 2/2006 | Puchalski | |
| D528,705 | S * | 9/2006 | Ide | D29/122 |
| 7,240,376 | B2 | 7/2007 | Ide et al. | |
| D552,800 | S * | 10/2007 | Ho | D29/105 |
| D558,928 | S | 1/2008 | Wise et al. | |
| D575,458 | S * | 8/2008 | Ho | D29/106 |
| D582,607 | S | 12/2008 | Ferrara et al. | |
| D584,001 | S | 12/2008 | Hunter et al. | |
| D587,407 | S | 2/2009 | Nimmons et al. | |
| D587,852 | S | 3/2009 | Nimmons | |
| D587,853 | S | 3/2009 | Nimmons | |
| D587,854 | S | 3/2009 | Nimmons et al. | |
| D587,855 | S | 3/2009 | Nimmons et al. | |
| D587,857 | S | 3/2009 | Nimmons et al. | |
| D857,854 | | 3/2009 | Nimmons et al. | |
| D857,855 | | 3/2009 | Nimmons et al. | |
| D590,106 | S | 4/2009 | Nimmons | |
| D603,099 | S | 10/2009 | Bologna et al. | |
| D603,100 | S | 10/2009 | Bologna | |
| 7,607,179 | B2 | 10/2009 | Shih | |
| D616,154 | S | 5/2010 | Daniel | |
| D625,050 | S | 10/2010 | Chen | |
| D628,748 | S | 12/2010 | Stewart | |
| D629,162 | S | 12/2010 | Daniel | |
| D633,658 | S | 3/2011 | Daniel | |
| 7,954,177 | B2 | 6/2011 | Ide et al. | |
| 8,095,995 | B2 * | 1/2012 | Alexander | A42B 3/324 2/410 |
| D654,629 | S | 2/2012 | Chou et al. | |
| D654,630 | S | 2/2012 | Chou et al. | |
| 2002/0104533 | A1 | 8/2002 | Kalhok et al. | |
| 2004/0025231 | A1 * | 2/2004 | Ide | A42B 3/08 2/425 |
| 2005/0278835 | A1 | 12/2005 | Ide et al. | |
| 2007/0192944 | A1 | 8/2007 | Ide et al. | |
| 2008/0163410 | A1 | 7/2008 | Udelhofen | |
| 2009/0044316 | A1 * | 2/2009 | Udelhofen | A42B 3/20 2/424 |
| 2009/0265841 | A1 | 10/2009 | Ferrara | |
| 2010/0005573 | A1 | 1/2010 | Rudd et al. | |
| 2011/0209272 | A1 | 9/2011 | Drake | |
| 2011/0277221 | A1 | 11/2011 | Ide et al. | |
| 2012/0011639 | A1 | 1/2012 | Beauchamp et al. | |
| 2012/0079646 | A1 | 4/2012 | Belanger et al. | |

FOREIGN PATENT DOCUMENTS

| | | |
|---|---|---|
| DE | 3338188 | 5/1985 |
| DE | 3603234 | 8/1987 |
| DE | 19745960 | 4/1999 |
| EP | 512193 | 11/1992 |
| GB | 256430 | 8/1926 |
| JP | 56-53735 | 5/1981 |
| JP | 57-205511 | 12/1982 |
| JP | 3-22024 | 3/1991 |
| JP | 05-132809 | 5/1993 |
| JP | 5-72922 | 10/1993 |
| JP | 07-109609 | 4/1995 |
| JP | 07-126908 | 5/1995 |
| JP | 10-195707 | 7/1998 |
| JP | 2001-020121 | 1/2001 |
| JP | 5937323 | 9/2011 |
| WO | WO95/34229 | 12/1995 |
| WO | WO01/52676 | 7/2001 |

OTHER PUBLICATIONS

Claim Construction Opinion and Order; *Riddell, Inc.* v. *Schutt Sports, Inc.*; U.S. District Court for the W.D. of Wisconsin; 08-cv-711.

Schutt's Response to Riddell's First Set of Interrogatories; including patent invalidity contentions and exhibit with invalidity claim charts; dated Mar. 13, 2009.

Schutt's Answer and Affirmative Defenses; *Riddell, Inc.* v. *Schutt Sports, Inc.*; U S. District Court for the W.O. of Wisconsin; 08-cv-711; dated Feb. 16, 2009.

Plaintiff Riddell's Brief in Support of Proposed Claim Constructions; dated Apr. 29, 2009.

Plaintiff Riddell's Opinion Brief to Defendant Schutt's Proposed Claim Constructions; dated May 18, 2009.

Defendant Schutt's First Supplemental Responses to Plaintiff Riddell's First Set of Interrogatories.

Declaration of Michael W. Irvin dated Aug. 30, 2012.

Schutt Photographs (Published Apr. 2001) (Exhibit 1 of Irvin Declaration).

Schutt Sports 2002 Football Catalog (Exhibit 2 of Irvin Declaration).

Supplemental Declaration of Michael W. Irvin Under 37 CFR § 1.132 and MPEP 2616 dated Dec. 27, 2012.

Rawlings Fall/Winter Sports Catalog 1926-1927.

Duma et al., Analysis of Real-time Head Accelerations in Collegiate Football Players, 15 Clin J Sport Med 7 (Jan. 2005).

Crisco et al., Frequency and Location of Head Impact Exposures in Individual Collegiate Football Players, 45 Journal of Athletic Training 550 (Dec. 2010).

Daniel et al., Head Impact Exposure in Youth Football, 40 Annals of Biomedical Engineering 976 (Feb. 2012).

* cited by examiner

HELMET WITH SHELL HAVING RAISED CENTRAL CHANNEL AND EAR HOLES WITH ABUTTING SLOPPED BANKS

CROSS-REFERENCE TO RELATED APPLICATIONS

This is a continuation of application Ser. No. 13/469,981, filed May 11, 2012 and now U.S. Pat. No. 8,499,366, which is a divisional of application Ser. No. 11/981,171 filed Oct. 31, 2007, and now U.S. Pat. No. 8,209,784, which applications are both incorporated herein by reference.

FIELD AND BACKGROUND OF THE INVENTION

The present invention relates to protective equipment for athletic competitions. More particularly, the present invention relates to protective helmets worn by athletes upon their heads during athletic competition.

Plastic football helmets have been known in the art. Initially faceguards were rigidly fastened to the plastic helmets by methods such as bolting. Later, the welded wire faceguard was redesigned to incorporate a flexible mounting system. Further, a loop strap attachment method was designed to provide an easy and universal method to attach the faceguards onto a wide variety of helmets. The molded loop straps absorbed energy caused by the multiple collisions sustained during the game, and the loop straps prevented the impact energy from being transmitted to the plastic football shell. Further, in the case of an emergency, the two lower side mount locations could be cut, and the faceguard could pivot about the top loop strap attachment points. As technology advanced, side loop straps have been placed in angular positions and in tension positions to allow the strap to better absorb the impacted energy by creating more distance for the strap to stretch and decelerate the impacted energy.

However, the thickness of the above described loop straps create separation between the shell of the helmet and the attached faceguard. This separation prevents the faceguard from being directly in contact with the shell of the helmet, and thus, the faceguard is prevented from being totally integrated into the design of the helmet.

SUMMARY OF THE INVENTION

In order to provide for an attachment mechanism for connecting a faceguard to a helmet which allows the faceguard to become totally integrated with the shell of the helmet in order to bring the faceguard into direct or substantially close contact with the shell of the helmet, a helmet and faceguard for accomplishing this is disclosed below.

In one aspect of the present invention, a helmet includes a shell configured to fit about a head of a wearer of the helmet. The shell includes a top portion that defines a front edge. The shell also includes a bottom portion adjoining the top portion. The bottom portion defines a first side edge that is integral with a first end of the front edge and a second side edge that is integral with a second end of the front edge. The front edge, first side edge, and second side edge define a segment of a circumference of the shell. The helmet further includes a faceguard having a faceguard assembly formed in a substantially closed loop. A top portion of the faceguard assembly overlies the top portion of the shell and substantially overlies and coincides with an entire shape of the front edge. The helmet includes a clamping mechanism that removably engages the top portion of the faceguard assembly so that the top portion of the faceguard assembly makes direct contact with the top portion of the shell.

In another aspect of the present invention, a helmet includes a shell configured to fit about a head of a wearer of the helmet. The shell includes a top portion that defines a front edge. The shell also includes a bottom portion adjoining the top portion. The bottom portion defines a first side edge that is integral with a first end of the front edge and a second side edge that is integral with a second end of the front edge. The front edge, first side edge, and second side edge define a segment of a circumference of the shell. The helmet further includes a faceguard having a faceguard assembly formed in a substantially closed loop. A top portion of the faceguard assembly overlies the top portion of the shell and substantially overlies and coincides with an entire shape of the front edge. At least a segment of a top portion of the faceguard assembly makes direct contact with the top portion of the shell.

In yet another aspect of the present invention, a helmet includes a shell configured to fit about a head of a wearer of the helmet. The shell includes a top portion that defines a front edge. The shell also includes a bottom portion adjoining the top portion. The bottom portion defines a first side edge that is integral with a first end of the front edge and a second side edge that is integral with a second end of the front edge. The front edge, first side edge, and second side edge define a segment of a circumference of the shell. The helmet further includes a faceguard having a faceguard assembly formed in a substantially closed loop. A top portion of the faceguard assembly overlies the top portion of the shell and substantially overlies and coincides with an entire shape of the front edge. The helmet includes an attachment assembly affixed to the shell. The attachment assembly defines an opening to receive a free end of the faceguard assembly. The attachment assembly and the free end of the faceguard assembly interact so that removal of the free end from the attachment assembly is prevented when a force is applied to the faceguard assembly toward the top portion of the shell.

In still another aspect of the present invention, a helmet includes a shell configured to fit about a head of a wearer of the helmet. The shell includes a top portion that defines a front edge. The shell also includes a bottom portion adjoining the top portion. The bottom portion defines a first side edge that is integral with a first end of the front edge and a second side edge that is integral with a second end of the front edge. The front edge, first side edge, and second side edge define a segment of a circumference of the shell. The helmet further includes a faceguard having a faceguard assembly formed in a substantially closed loop. A top portion of the faceguard assembly overlies the top portion of the shell and substantially overlies and coincides with an entire shape of the front edge. The helmet further includes an attachment assembly affixed to the shell. The attachment assembly defines an opening to receive a tree end of the faceguard assembly. The attachment assembly includes an impact absorbing stop that engages the free end of the faceguard assembly and compresses when a force is applied to the faceguard assembly toward the top portion of the shell so as to dissipate energy generated from the force.

In still another aspect of the present invention, a helmet includes a shell configured to fit about a head of a wearer of the helmet. The shell includes a top portion that defines a front edge. The shell also includes a bottom portion adjoining the top portion. The bottom portion defines a first side edge that is integral with a first end of the front edge and a second side edge that is integral with a second end of the front edge. The front edge, first side edge, and second side edge define a segment of a circumference of the shell. The helmet further includes a faceguard having a faceguard assembly formed in a substantially closed loop. A top portion of the faceguard assembly overlies the top portion of the shell and substantially overlies and coincides with an entire shape of the front edge. The helmet includes a clamping mechanism that removably engages the top portion of the faceguard assembly so that the top portion of the faceguard assembly makes direct contact with the top portion of the shell. The helmet further includes an attachment assembly affixed to the shell. The attachment assembly defines an opening to receive a free end of the faceguard assembly of the faceguard. The attachment assembly and the free end of the faceguard assembly of the faceguard interact so that removal of the free end from the attachment assembly is prevented when a force is applied to the faceguard assembly toward the top portion of the shell.

In yet another aspect of the present invention, a helmet includes a shell configured to fit about a head of a wearer of the helmet. The shell includes a top portion that defines a front edge. The shell also includes a bottom portion adjoining the top portion. The bottom portion defines a first side edge that is integral with a first end of the front edge and a second side edge that is integral with a second end of the front edge. The front edge, first side edge, and second side edge define a segment of a circumference of the shell. The helmet further includes a faceguard having a faceguard assembly formed in a substantially closed loop. A top portion of the faceguard assembly overlies the top portion of the shell and substantially overlies and coincides with an entire shape of the front edge. The helmet includes a clamping mechanism that removably engages the top portion of the faceguard assembly so that the top portion of the faceguard assembly makes direct contact with the top portion of the shell. The helmet further includes an attachment assembly affixed to the shell. The attachment assembly defines an opening to receive a free end of the faceguard assembly of the faceguard. The attachment assembly includes an impact absorbing stop that engages the free end of the faceguard assembly and compresses when a force is applied to the faceguard assembly toward the top portion of the shell so as to dissipate energy generated from the force.

In still another aspect of the present invention, a faceguard includes a first faceguard assembly having a lop portion and a bottom portion formed in a first substantially closed loop. The faceguard further includes a second faceguard assembly having a top portion and a bottom portion formed in a second substantially closed loop. A portion of the second faceguard assembly has an exterior circumference that matches in shape a portion of an interior circumference of the first faceguard assembly. The portion of the second faceguard assembly is joined to the first faceguard assembly along the entire portion of the interior circumference.

In another aspect of the present invention, a method of attaching a faceguard to a helmet includes the steps of providing a helmet having a shell configured to fit about a head of a wearer of the helmet. The shell includes a top portion that defines a front edge and a bottom portion adjoining the top portion. The bottom portion defines a first side edge that is integral with a first end of the front edge and a second side edge that is integral with a second end of the front edge. The front edge, first side edge, and second side edge define a segment of a circumference of the shell. The helmet further includes an attachment assembly affixed to the shell defining an opening. A faceguard is provided having a faceguard assembly formed in a substantially closed loop. A free end of the faceguard assembly is inserted within the opening of the attachment assembly. The faceguard is rotated toward the top portion of the shell. A top portion of the faceguard is engaged to a clamping mechanism and the clamping mechanism is connected to the front edge of the shell.

In still yet another aspect of the invention, a method of detaching a faceguard from a helmet includes the steps of providing a helmet having a shell configured to fit about a head of a wearer of the helmet. The shell includes a top portion that defines a front edge and a bottom portion adjoining the top portion. The bottom portion defines a first side edge that is integral with a first end of the front edge and a second side edge that is integral with a second end of the front edge. The front edge, first side edge, and second side edge define a segment of a circumference of the shell. A faceguard is provided including a faceguard assembly formed in a substantially closed loop. A top portion of the faceguard is connected to the front edge by a clamping mechanism and a free end of the faceguard is removably attached to an attachment mechanism, the attachment assembly defining an opening. The clamping mechanism is cut to disengage the faceguard from the shell. The faceguard is pulled in a direction away form the front edge of the shell. The faceguard is then rotated in a direction away from the top portion of the shell of the helmet. The faceguard is then removed from the attachment assembly.

In another aspect of the invention, a helmet includes a shell configured to fit about a head of a wearer of the helmet. The helmet further includes a faceguard attached to the shell having a faceguard assembly and a tab extension integral with the faceguard assembly. The helmet also includes a chinstrap having at least one leg. The tab extension is configured to engage the at least one leg of the chinstrap and the at least one leg of the chinstrap is threaded through an opening of the tab extension and attached to the shell.

In still another aspect of the invention, a method of attaching a chinstrap to a helmet includes the steps of providing a helmet, the helmet comprising a shell configured to fit about a head of a wearer of the helmet. The shell includes a top portion defining a front edge and a bottom portion adjoining the top portion. The bottom portion defines a side edge that is integral with an end of the front edge. A faceguard is provided having a faceguard assembly and a tab extension integral with the faceguard assembly. A chinstrap is provided having a leg. The leg is threaded through an opening of the tab extension in a direction towards the side edge of the shell. The leg of the chinstrap is then pulled in a direction away from the top portion of the shell and attached to the shell.

Further advantages, as well as details of the present invention ensue from the following description of the attached drawings.

DESCRIPTION OF THE PREFERRED EMBODIMENTS

Figure 1A:
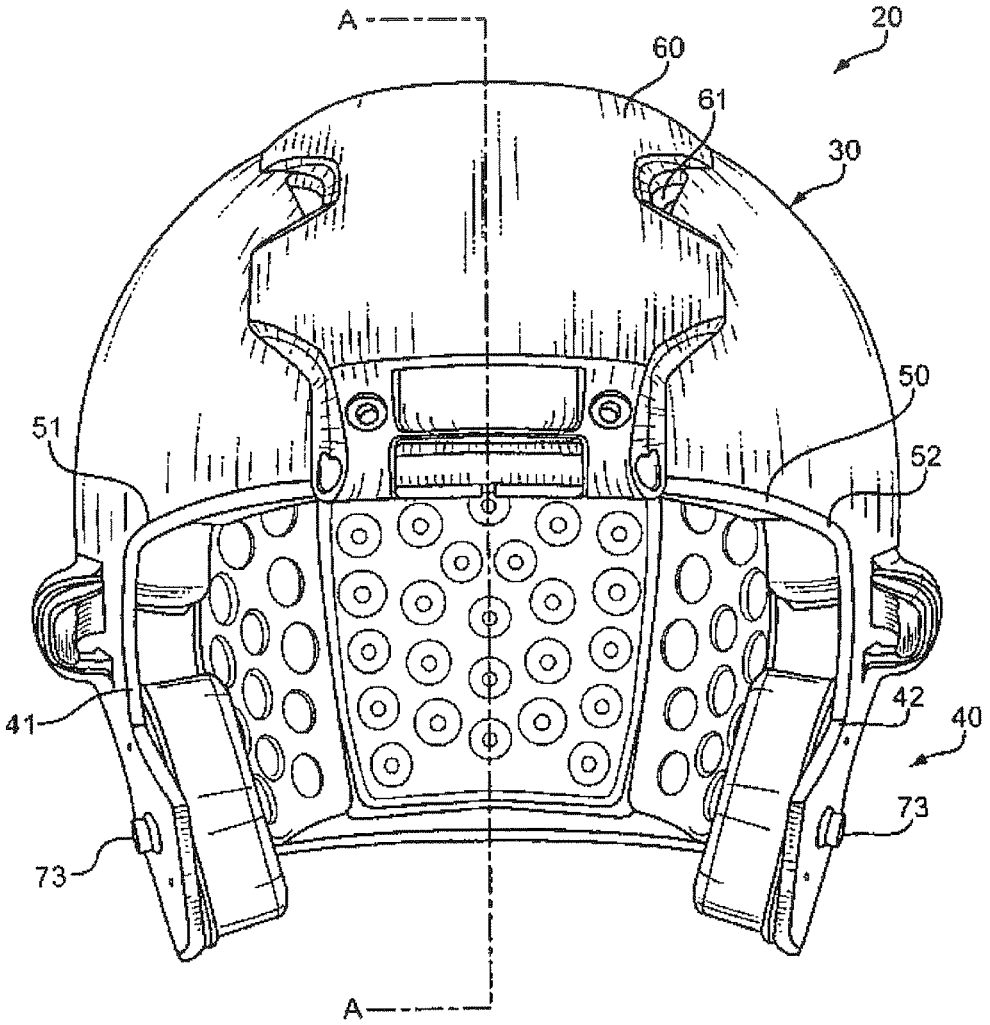
FIG. 1A is a front view of an embodiment of a shell with protective padding to be used with a helmet in accordance with the present invention.
Figure 1B:
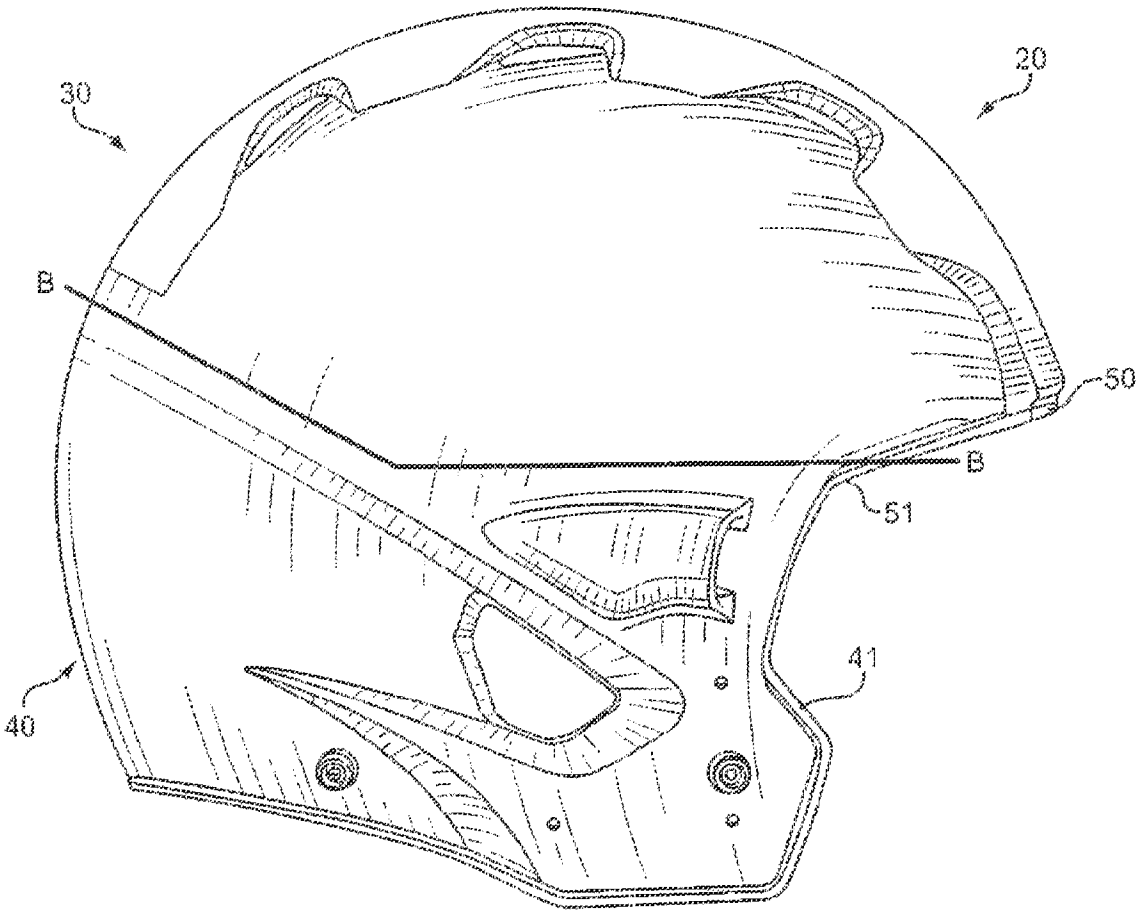
FIG. 1B is a side view of the shell in FIG. 1A.
Figure 1C:
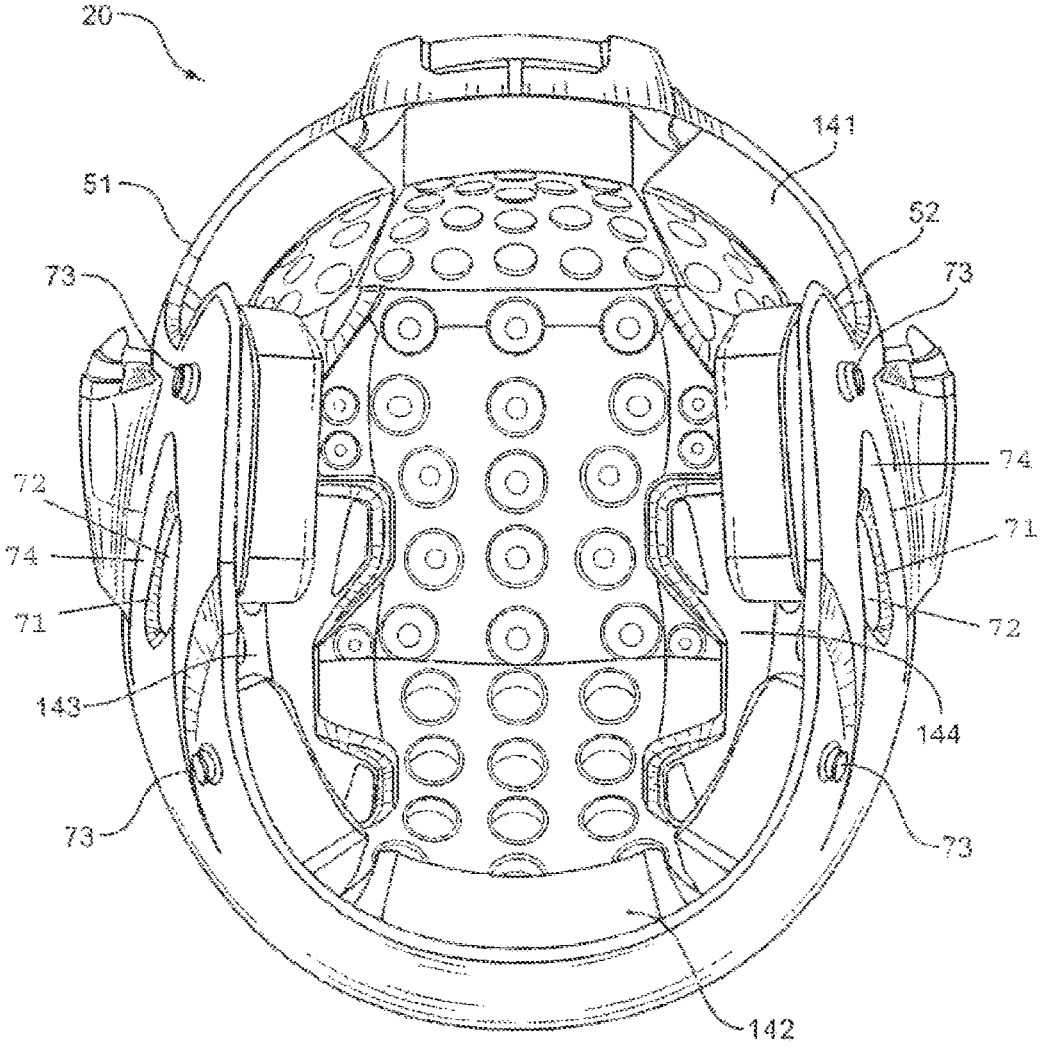
FIG. 1C is a bottom view of the shell in FIG. 1A.

Referring to FIGS. 1A-1C, one embodiment of a shell 20 of a helmet 10 of the present invention is provided. The helmet 10 shown in FIGS. 2A-2C includes the shell of FIGS. 1A-1C with a faceguard 100. In this particular embodiment, the helmet 10 is a protective helmet worn by athletes playing the game of football. Alternatively, in another embodiment of the present invention, the helmet 10 may be altered to be a protective helmet worn by athletes playing other games that require facial protection, including, but not limited to, baseball, hockey, and lacrosse.

The helmet 10 includes a shell 20 configured to fit about the head of a wearer of the helmet 10. Referring to FIG. 1B, the shell 20 includes a top portion 30 and a bottom portion 40 integrally attached to the top portion 30. The separation between the top portion 30 and the bottom portion 40 is represented by line B-B. The top portion 30 of the shell 20 is configured to protect the topmost part of the wearer's head. The top portion 30 of the shell 30 defines a front edge 50 of the shell 20. As shown by FIG. 1A, the front edge 50 has a first end 51 and a second end 52. The top portion 30 also includes a central, raised, corrugated channel 60. Preferably, the channel 60 is raised in a direction away from the shell 20 of the helmet 10, at least at one of the front area and top area of the helmet shell as illustrated in FIGS. 1B and 2B. The corrugated channel 60 has a plurality of elongated vent openings 61 on each side, spaced from each other and elongated, from front to back along the helmet shell. The raised corrugated channel 60 and the plurality of openings 61 are configured to provide ventilation to the head of a wearer of the helmet 10. In addition, the corrugated channel 60 provides increased strength to the helmet 10. This increased strength is beneficial because the shell 20 of the helmet 10 is subject to multiple collisions throughout its use.

Figure 7:
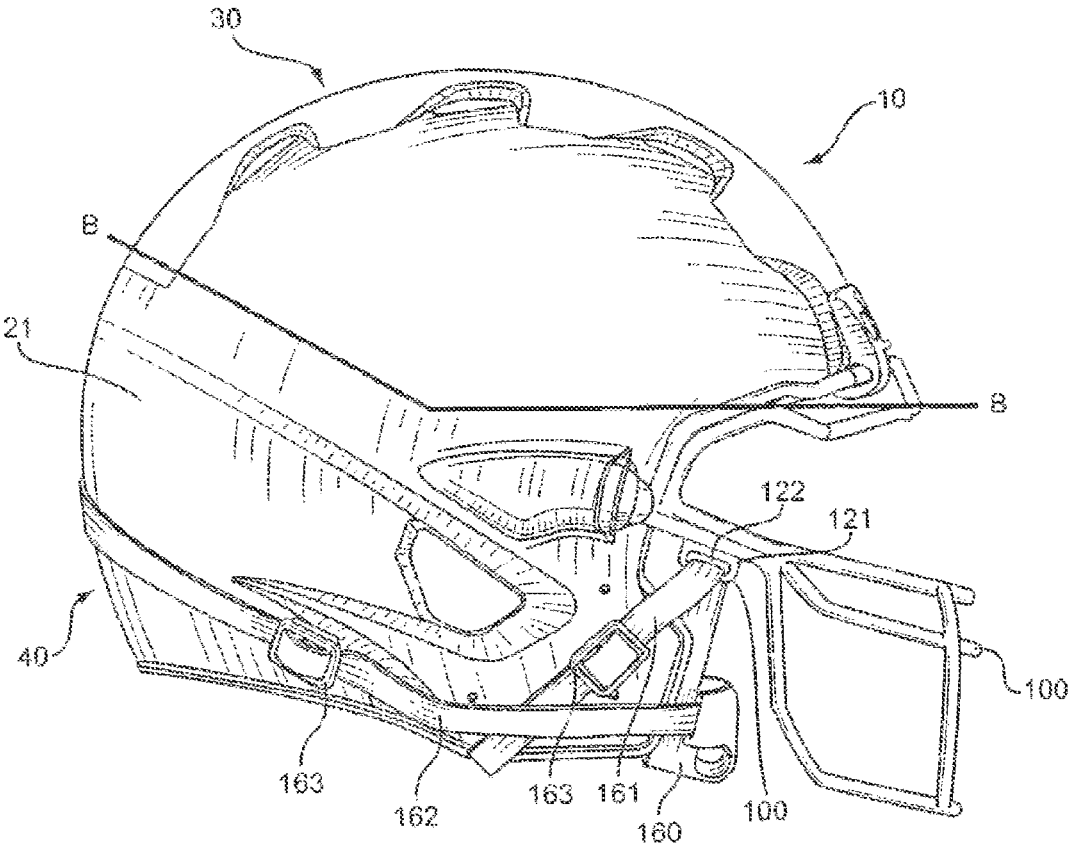
FIG. 7 is a side view of the helmet of FIG. 2B including an embodiment of a chinstrap to be used in accordance with the present invention.
Figure 8:
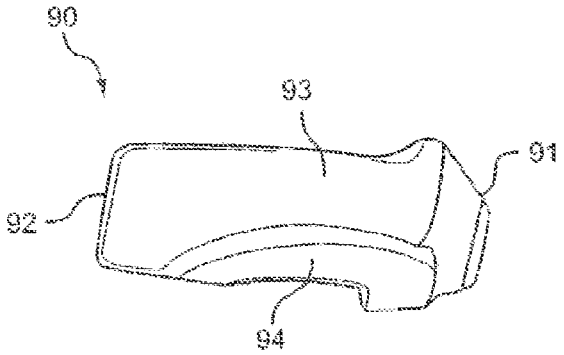
FIG. 8 is a side view of an embodiment of an impact absorbing stop for use with the helmet of FIGS. 2A-2C in accordance with the present invention.

The bottom portion 40 of the shell 20 is integrally affixed to the top portion 30 of the shell 20. The bottom portion 40 defines a first side edge 41 and a second side edge 42. As shown by FIG. 1A, the first side edge 41 and the second side edge 42 are integral with the first end 51 and the second end 52 of the front edge 50. The front edge 50 of the top portion 30 of the shell 20, and the first side edge 41 and the second side edge 42 of the bottom portion 40 of the shell 20 ultimately define a segment of a circumference of the shell 20. Referring now to FIG. 1B, the bottom portion 40 includes earholes 70. Each earhole 70 faces opposite each other and is provided on a right side 21 and a left side 22 of the shell 20. The earhole 70 is configured to fit over the ear of the wearer of the helmet. The edges 71 of each earhole 70 define an opening 72 that the wearer may place their fingers to remove the helmet 10 from upon their head. Sloped banks 74 descend from the surface of the shell to the earhole opening 72. The bottom portion 40 of the shell 20 may also include a pair of connectors 73. The connectors 73 are adapted to receive the legs 161, 162 of a chinstrap 160, as shown by FIG. 7.

Figure 2A:
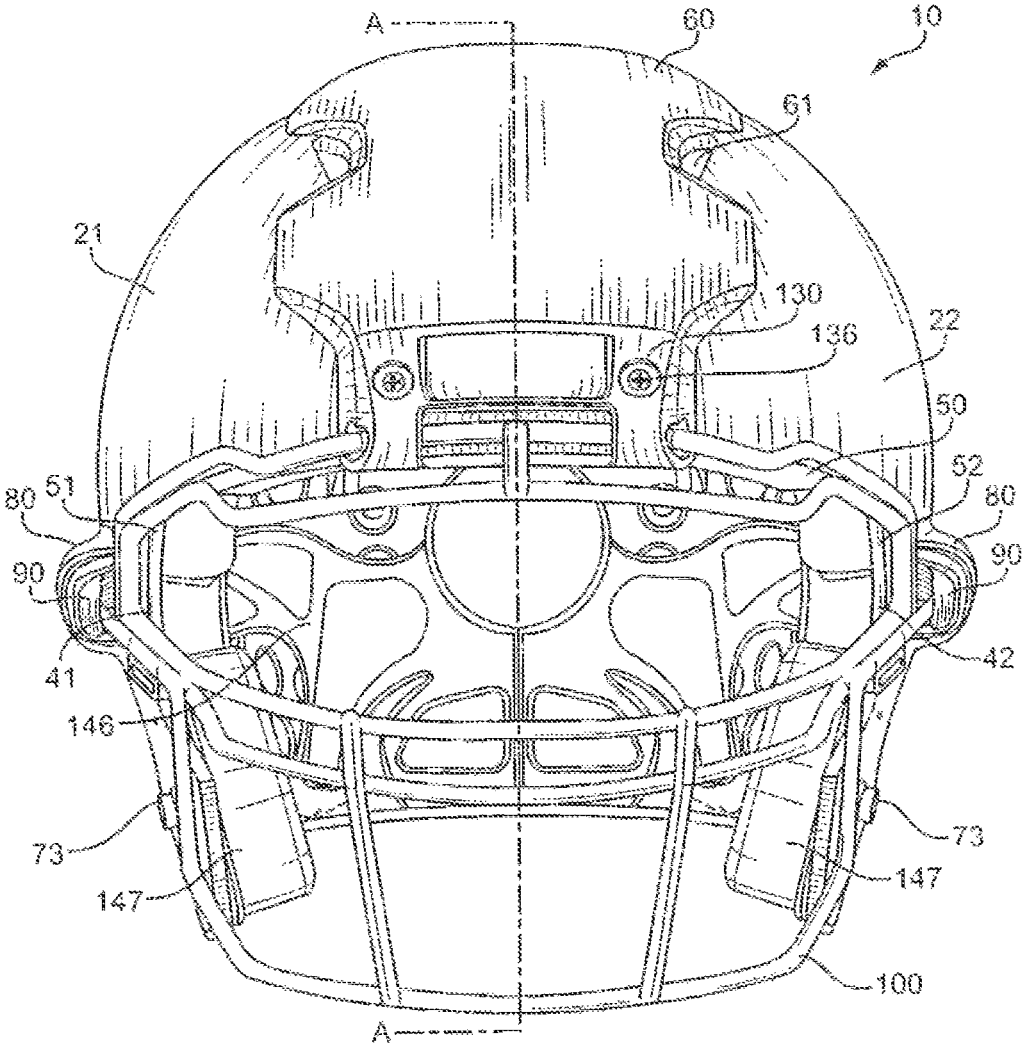
FIG. 2A is a front view of an embodiment of a helmet that uses the shell of FIGS. 1A-1C in accordance with the present invention.
Figure 2B:
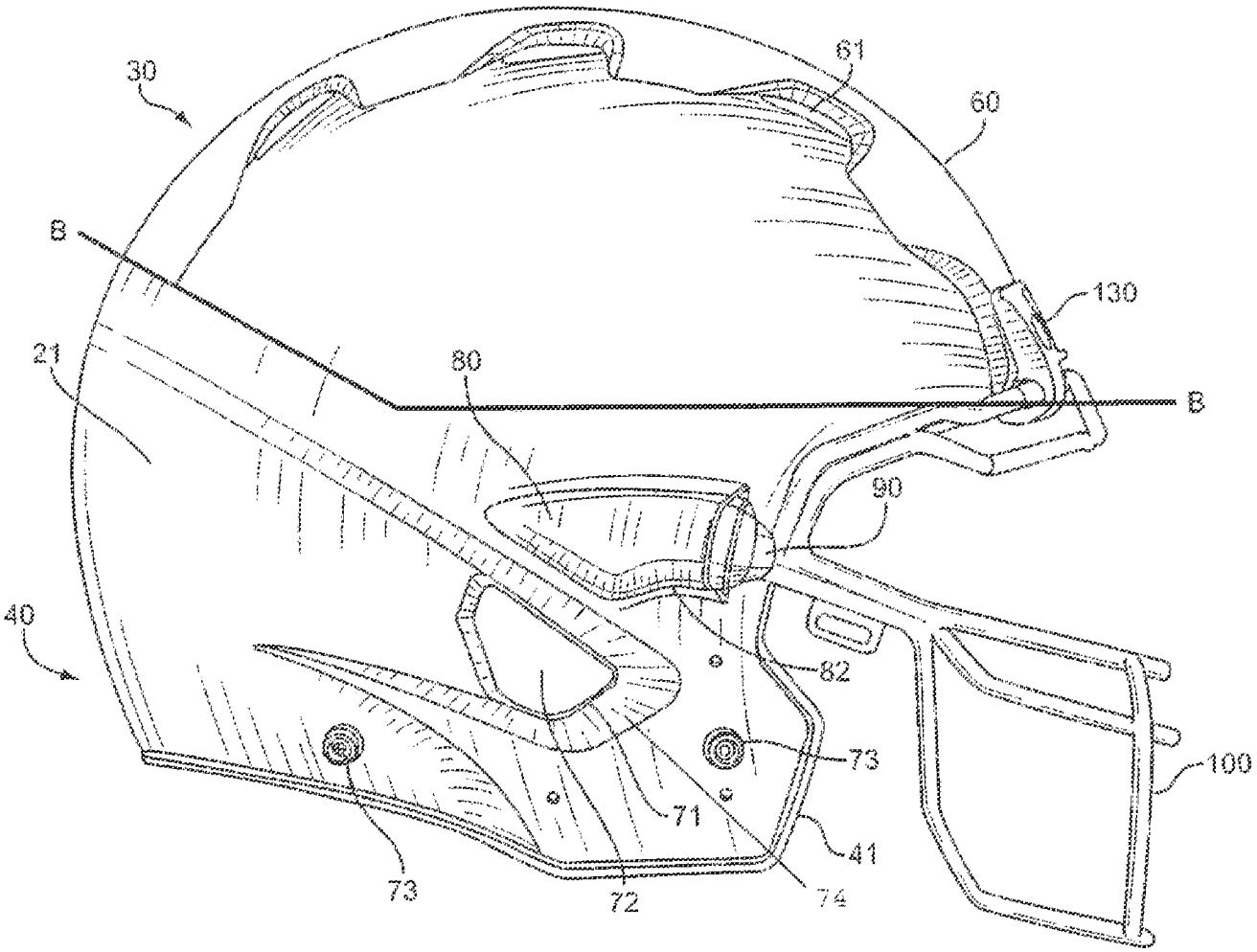
FIG. 2B is a side view of the helmet of FIG. 2A.

As shown in FIG. 2A, in this particular embodiment, a faceguard, generally indicated at 100, is mounted on the shell 20 of the helmet 10. Referring now to FIG. 3, the faceguard 100 has a first wire or faceguard assembly 101. The first wire assembly 101 includes a top portion 104 and a bottom portion 105 that are joined together to form a substantially closed loop having an interior circumference 102 and an exterior circumference 103. Alternatively, the first wire assembly 101 may comprise one continuous wire segment which forms a substantially closed loop. Referring back to FIGS. 2A-2C, the top portion 104 of the first wire assembly 101 overlies the top portion 30 of the shell 20. Furthermore, the top portion 104 of the first wire assembly 101 substantially overlies and coincides with an entire shape of the front edge 50 of the shell 20. The bottom portion 105 of the first wire assembly 101 has a concave configuration to provide protection to a lower portion of the wearer's face. The first wire assembly 101 also includes curved wire or faceguard segments 106 that are configured to fit within an attachment assembly 80, which will be discussed further below. The top portion 104 of the first wire assembly 101 is joined to the curved wire segments 106 at joint 116. Further, the curved wire segments 106 are joined to a bottom portion 105 of the first wire assembly 101 at joint 117. The wire segments of the first wire assembly may be joined together by techniques known to one of the ordinary skill in the art. Preferably, the wire segments are joined together by metal inert gas (MIG) welding.

The faceguard 100 includes a second wire or faceguard assembly 107 having top portion 110 and a bottom portion 111 that are joined together at joint 118 to form a substantially closed loop having an interior circumference 108 and an exterior circumference 109. Alternatively, the second wire assembly 101 may comprise one continuous wire segment which forms a substantially closed loop. A portion 114 of the exterior circumference 109 of the second wire assembly 104 is configured such that it matches in shape a portion 115 of the interior circumference 102 of the first wire assembly 101.

Preferably, the first wire assembly 101 and the second wire assembly 107 are joined together by MIG welding. In addition, the faceguard 100 includes a third wire or faceguard assembly 112. The ends 113 of the third wire assembly 112 are preferably MIG welded to the first wire assembly 101 and the second wire assembly 107 at joint 119. Vertical wire or faceguard segments 120 interconnect the bottom portion 105 of the first wire assembly 101, the second wire assembly 107, and the third wire assembly 112. A vertical wire segment 120 also interconnects the top portion 104 of the first wire assembly 101 and the top portion 110 of the second wire assembly 107. The vertical wire segments 120 are preferably flat wire segments having two flat sides and two rounded edges. The flat wire segments provide a flatter profile on the faceguard 100 which reduces the secondary grinding operation that is prevalent when using traditional round wire. The vertical wire segments 120 are preferably resistance welded at the points the vertical wire segments 120 contact the wire assemblies of the faceguard 100.

The first wire assembly 101 includes a pair of tab extensions 121. FIG. 3 shows that an opening 122 is disposed through the tab extensions 121. The opening 122 is configured to receive an upper leg 161 of a four point chinstrap 160 and may have a diameter of about 0.625 inches. As shown in FIG. 7, the upper leg 161 of the chinstrap 160 is threaded through the opening 122 of the tab extension 121 from the inside of the faceguard 100. A buckle 163 may be attached to the legs 161, 162 of the chinstrap 160 in order to attach the legs 161, 162 to one of the connectors 73. After threading the upper leg 161 of the chinstrap 160 through the opening, the wearer of the helmet 10 pulls the upper leg 161 in a direction away from the top portion 30 of the shell 20 and attaches the buckle 163 to a connector 73. This chinstrap routing location provides a better mechanical advantage when the wearer of the helmet 10 adjusts the chinstrap 160 because it allows the wearer to apply a downward force away from the shell 20 of the helmet 10. This downward force causes the shell 20 to move in the direction of the wearer in order to produce a closer fit. A second upper leg of the chinstrap 160 may be attached on the opposite side of the shell 20 in the same manner. In the alternative, when the faceguard 100 is attached to the front edge 50 of the shell 10, a space may be provided between the faceguard 100 and the shell 20 to allow the upper leg of a chinstrap to be placed in the more traditional position upon top portion 30 of the shell 20 by the use of a connector 73. Furthermore, a V-shaped notch (not shown) can be placed on either side 21, 22 of the shell 20. A lower leg 162 of a chinstrap 160 may be passed through the notch and attached to one of the connectors 73. A protective plastic coating may also be added to the surface of the faceguard 100 to cover the wire terminations of the wire assemblies and wire segments of the faceguard 100.

Figure 4:
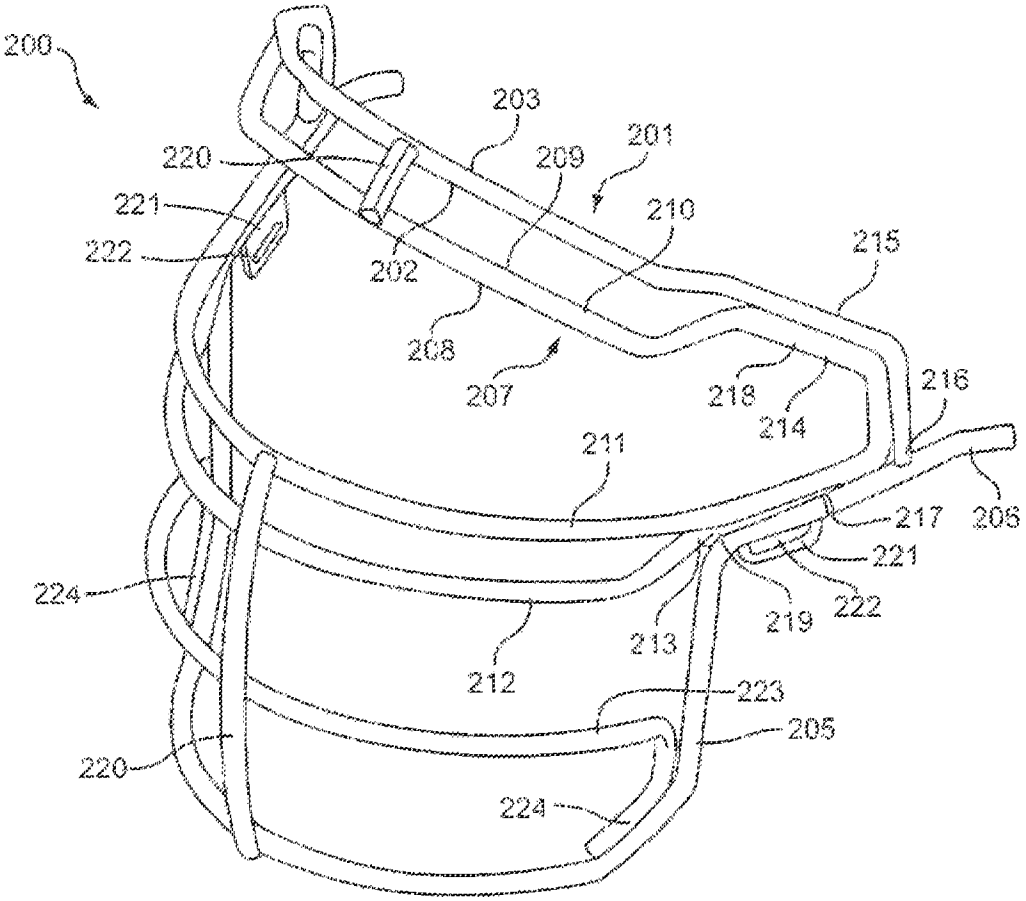
FIG. 4 is a perspective view of a second embodiment of a faceguard to be used with the helmet of FIGS. 2A-2C in accordance with the present invention.

A second embodiment of a faceguard 200 to be used with the shell and the helmet of FIGS. 1A-1C and 2A-2C, respectively, is shown by FIG. 4. The faceguard 200 includes a first wire or faceguard assembly 201, a second wire or faceguard assembly 207, a third wire or faceguard assembly 212, and a fourth wire or faceguard assembly 223. The first wire assembly 201 includes a top portion 204 and a bottom portion 205 that are joined together to form a substantially closed loop having an interior circumference 202 and an exterior circumference 203. Alternatively, the first wire assembly 201 may comprise one continuous wire segment which forms a substantially closed loop. The first wire assembly 201 also includes curved wire or faceguard segments 206 that are configured to fit within the attachment assembly 80. The top portion 204 of the first wire assembly 201 is joined to the curved wire segments 206 at joint 216. Further, the curved wire segments 206 are joined to a bottom portion 205 of the first wire assembly 101 at joint 217. The second wire assembly 207 includes top portion 210 and a bottom portion 211 that are joined together at joint 218 to form a substantially closed loop having an interior circumference 208 and an exterior circumference 209. Alternatively, the second wire assembly 207 may comprise one continuous wire segment which forms a substantially closed loop. A portion 214 of the second wire assembly 207 matches in shape a portion 215 of the interior circumference 202 of the first wire assembly 201. The ends 213 of the third wire assembly 212 are preferably MIG welded to the first wire assembly 201 and the second wire assembly 207 at joint 219. Portions 224 of the fourth wire assembly 223 engage an inner surface of the bottom portion 205 of the first wire assembly 201. A vertical wire or faceguard segment 220 is provided that interconnects the bottom portion 205 of the first wire assembly 201, the bottom portion 211 of the second wire assembly 207, the third wire assembly 212, and the fourth wire assembly 223. In addition, a vertical wire segment 220 interconnects the top portion 204 of the first wire assembly 201 and the top portion 210 of the second wire assembly 207. The vertical wire segments 220 are joined to the wire assemblies by techniques known in the art. Preferably, resistance welds are applied to the vertical wire segments 220 at the points the vertical wire segments 220 contact the wire assemblies of the faceguard 200. The vertical wire segments 220 are preferably flat wire having two flat sides and two rounded edges.

When the faceguard 200 is positioned upon the shell 20 and the curved wire segments 206 are secured in the attachment assemblies 80 of the helmet 10, the top portion 204 of the first wire assembly 201 overlies the top portion 30 of the shell 20 and substantially overlies and coincides with an entire shape of the front edge 50 of the shell 20. The faceguard 200 also includes tab extensions 221 with an opening 222 to receive an upper leg 161 of a chinstrap 160. The opening 222 is configured to receive an upper leg of a four point chinstrap and may have a diameter of about 0.625 inches. In operation, the upper leg 161 of the chinstrap 160 is threaded through the opening 222 of the tab extension 221 from the inside of the faceguard 200. After threading the upper leg 161 of the chinstrap 160 through the opening, the wearer of the helmet 10 pulls the upper leg 161 in a direction away from the top portion 30 of the shell 20 and attaches to the shell 20. This chinstrap routing location provides a better mechanical advantage when the wearer of the helmet 10 adjusts the chinstrap 160 because it allows the wearer to apply a downward force away from the shell 20 of the helmet 10. This downward force causes the shell 20 to move in the direction of the wearer in order to produce a closer fit. A second upper leg of the chinstrap 160 may be attached on the opposite side of the shell 20 in the same manner. In the alternative, when the faceguard 200 is attached to the front edge 50 of the shell 10, a space may be provided between the faceguard 200 and the shell 20 to allow the upper leg 161 of a chinstrap 160 to be placed in the more traditional position upon the top portion 30 of the shell 20 by the use of a connector 73. Furthermore, a V-shaped notch (not shown) can be placed on either side 21, 22 of the shell 20, where a lower leg 162 of a chinstrap 160 may be passed through the notch and attached to one of the connectors 73. A protective plastic coating may also be added to the surface of the faceguard 200 to cover the wire terminations of the wire assemblies and wire segments of the faceguard 200.

Figure 5:
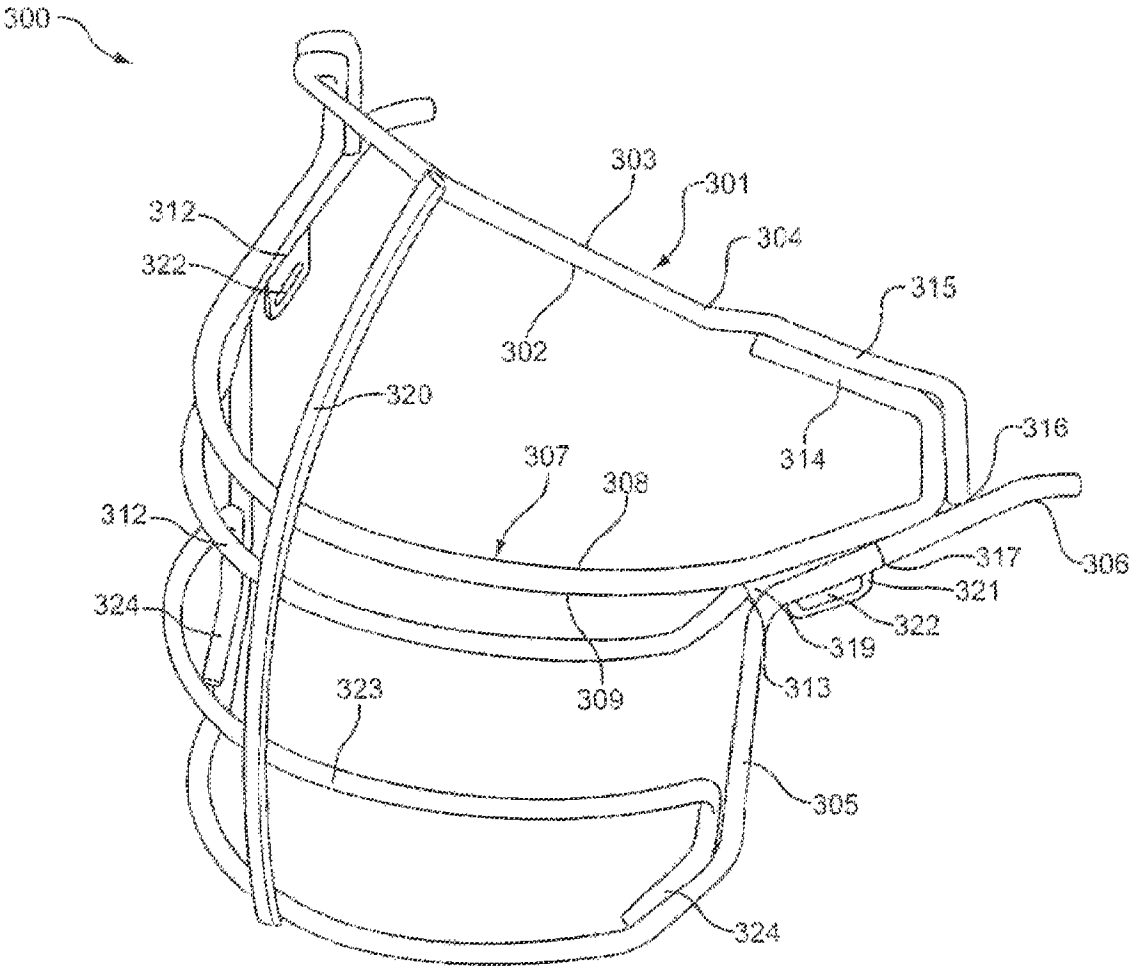
FIG. 5 is a perspective view of a third embodiment of a faceguard to be used with the helmet of FIGS. 2A-2C in accordance with the present invention.

A third embodiment of the faceguard 300 to be used with the shell and the helmet of FIGS. 1A-1C and 2A-2C, respectively, is shown in FIG. 5. The faceguard 300 includes a first wire or faceguard assembly 301, a second wire or faceguard assembly 307, a third wire or faceguard assembly 312, and a fourth wire or faceguard assembly 323. The first wire assembly 301 includes a top portion 304 and a bottom portion 305 that are joined together to form a substantially closed loop having an interior circumference 302 and an exterior circumference 303. Alternatively, the first wire assembly 301 may comprise one continuous wire segment which forms a substantially closed loop. The first wire assembly 301 also includes curved wire or faceguard segments 306 that are configured to fit within the attachment assembly 80. The top portion 304 of the first wire assembly 301 is joined to the curved wire segments 306 at joint 316. Further, the curved wire segments 306 are joined to a bottom portion 305 of the first wire assembly 301 at joint 317. The second wire assembly 307 has an interior circumference 308 and an exterior circumference 309, where a portion 314 of the second wire assembly 307 matches in shape a portion 315 of the interior circumference 302 of the first wire assembly 301. The ends 313 of the third wire assembly 312 are preferably MIG welded to the first wire assembly 301 and the second wire assembly 307 at joint 319. Portions 324 of the fourth wire assembly 323 engage an inner surface of the bottom portion 305 of the first wire assembly 301. A single vertical wire or faceguard segment 320 is provided that interconnects the bottom portion 305 of the first wire assembly 301, the second wire assembly 307, the third wire assembly 312, and the fourth wire assembly 323. The vertical wire segment 320 is joined to the wire assemblies by techniques known in the art. Preferably, resistance welds are applied to the vertical wire segment 320 at the points where the vertical wire segment 320 contacts the wire assemblies of the faceguard 300. The vertical wire segment 320 is preferably flat wire having two flat sides and two rounded edges.

When the faceguard 300 is positioned upon the shell 20 and the curved wire segments 306 are secured in the attachment assemblies 80 of the helmet 10, the top portion 304 of the first wire assembly 301 overlies the top portion of the shell 20 and substantially overlies and coincides with an entire shape of the front edge 50 of the shell 20. The faceguard 300 also includes tab extensions 321 with an opening 322 to receive a leg of a chinstrap. The opening 322 is configured to receive an upper leg 161 of a four point chinstrap 160 and may have a diameter of about 0.625 inches. In operation, the upper leg 161 of the chinstrap 160 is threaded through the opening 322 of the tab extension 321 from the inside of the faceguard 300. After threading the upper leg 161 of the chinstrap 160 through the opening, the wearer of the helmet 10 pulls the upper leg 161 in a direction away from the top portion 30 of the shell 20 and attaches to the shell 20. This chinstrap routing location provides a better mechanical advantage when the wearer of the helmet 10 adjusts the chinstrap 160 because it allows the wearer to apply a downward force away from the shell 20 of the helmet 10. This downward force causes the shell 20 to move in the direction of the wearer in order to produce a closer fit. A second upper leg of the chinstrap 160 may be attached on the opposite side of the shell 20 in the same manner. In the alternative, when the faceguard 300 is attached to the front edge 50 of the shell 10, a space may be provided between the faceguard 300 and the shell 20 to allow the upper leg 161 of a chinstrap 160 to be placed in the more traditional position upon the top portion 30 of the shell 20 by the use of a connector 73. Furthermore, a V-shaped notch (not shown) can be placed on either side 21, 22 of the shell 20, where a lower leg 162 of a chinstrap 160 may be passed through the notch and attached to one of the connectors 73. A protective plastic coating may also be added to the surface of the faceguard 300 to cover the wire terminations of the wire assemblies and wire segments of the faceguard 300.

Figure 6:
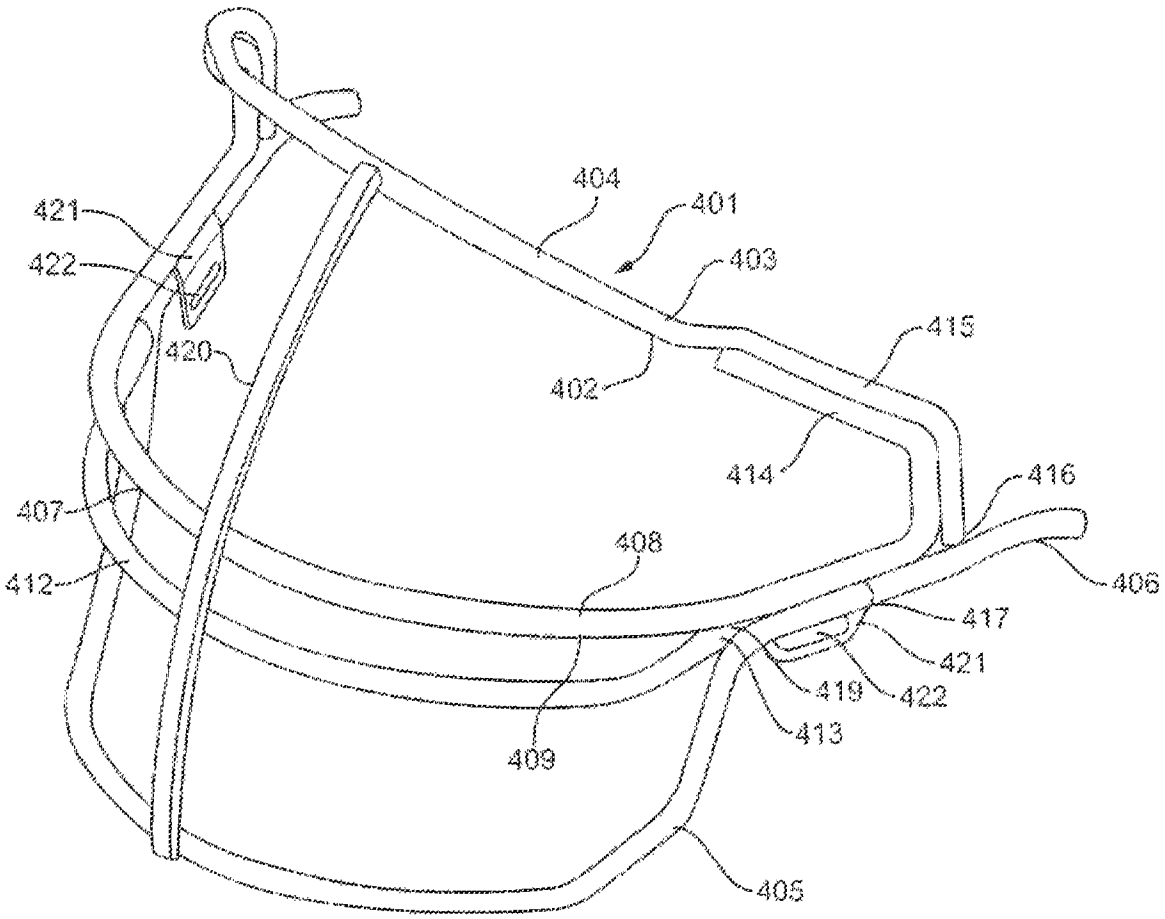
FIG. 6 is a perspective view of a fourth embodiment of a faceguard to be used with the helmet of FIGS. 2A-2C in accordance with the present invention.

A fourth embodiment of the faceguard 400 to be used with the shell and the helmet of FIGS. 1A-1C and 2A-2C, respectively, is shown in FIG. 6. The faceguard 400 includes a first wire or faceguard assembly 401, a second wire or faceguard assembly 407, and a third wire or faceguard assembly 412. The first wire assembly 401 includes a top portion 404 and a bottom portion 405 that are joined together to form a substantially closed loop having an interior circumference 402 and an exterior circumference 403. Alternatively, the first wire assembly 401 may comprise one continuous wire segment which forms a substantially closed loop. The first wire assembly 401 also includes curved wire or faceguard segments 406 that are configured to fit within the attachment assembly 80. The top portion 404 of the first wire assembly 401 is joined to the curved wire segments 406 at joint 416. Further, the curved wire segments 406 are joined to a bottom portion 405 of the first wire assembly 401 at joint 417. The second wire assembly 407 has an interior circumference 405 and an exterior circumference 406, where a portion 314 of the second wire assembly 407 matches in shape a portion 415 of the interior circumference 402 of the first wire assembly 401. The ends 413 of the third wire assembly 412 are preferably MIG welded to the first wire assembly 401 and the second wire assembly 407 at joint 419. A single vertical wire or faceguard segment 420 is provided that interconnects the bottom portion 405 of the first wire assembly 401, the second wire assembly 407, and the third wire assembly 412. The vertical wire segment 420 is joined to the wire assemblies by techniques known in the art. Preferably, resistance welds are applied to the vertical wire segment 420 at the points where the vertical wire segment 320 contacts the wire assemblies of the faceguard 400. The vertical wire segment 420 is preferably flat wire having two flat sides and two rounded edges.

When the faceguard 400 is positioned upon the shell 20 and the curved wire segments are secured in the attachment assemblies 80 of the helmet 10, the top portion 404 of the first wire assembly 401 overlies the top portion of the shell 20 and substantially overlies and coincides with an entire shape of the front edge 50 of the shell 20. The faceguard 400 also includes tab extensions 421 with an opening 422 to receive a leg of a chinstrap. The opening 422 is configured to receive an upper leg 161 of a four point chinstrap 160 and may have a diameter of about 0.625 inches. In operation, the upper leg of the chinstrap is threaded through the opening 422 of the tab extension 421 from the inside of the faceguard 400. After threading the upper leg 161 of the chinstrap 160 through the opening, the wearer of the helmet 10 pulls the upper leg 161 in a direction away from the top portion 30 of the shell 20 and attaches to the shell 20. This chinstrap routing location provides a better mechanical advantage when the wearer of the helmet 10 adjusts the chinstrap 160 because it allows the wearer to apply a downward force away from the shell 20 of the helmet 10. This downward force causes the shell 20 to move in the direction of the wearer in order to produce a closer fit. A second upper leg of the chinstrap 160 may be attached on the opposite side of the shell 20 in the same manner. In the alternative, when the faceguard 400 is attached to the front edge 50 of the shell 10, a space may be provided between the faceguard 400 and the shell 20 to allow the upper leg 161 of a chinstrap 160 to be placed in the more traditional position upon the top portion 30 of the shell 20. Furthermore, a V-shaped notch (not shown) can be placed on either side 21, 22 of the shell 20, where a lower leg 162 of a chinstrap 160 may be passed through the notch and attached to one of the connectors 73. Furthermore, a V-shaped notch (not shown)

can be placed on either side 21, 22 of the shell 20. A lower leg of a chinstrap may be passed through the notch and attached to one of the connectors 73. A protective plastic coating may also be added to the surface of the faceguard 400 to cover the wire terminations of the wire assemblies and wire segments of the faceguard 400.

Figure 12A:
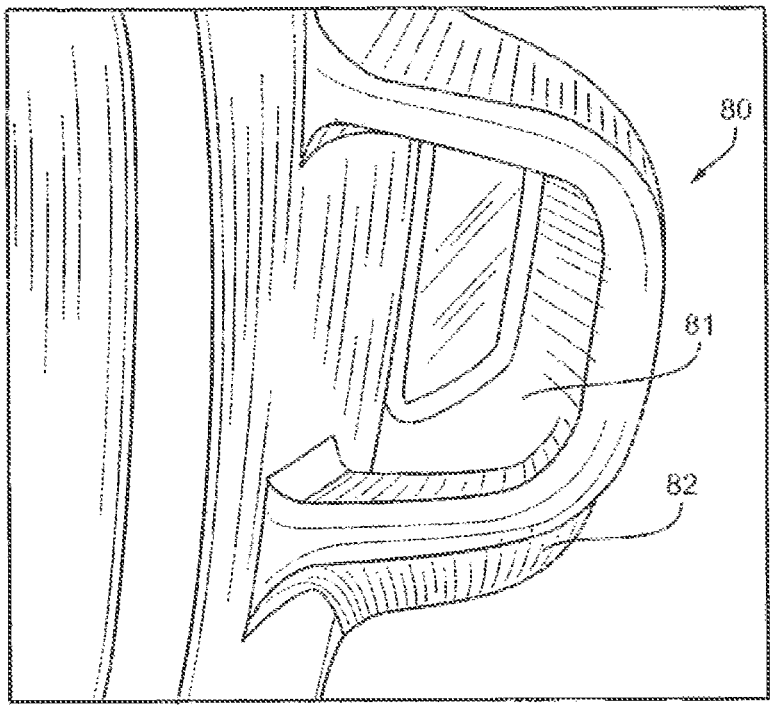
FIG. 12A is a front view of an embodiment of an attachment assembly for use with the helmet of FIGS. 2A-2C in accordance with the present invention.
Figure 12B:
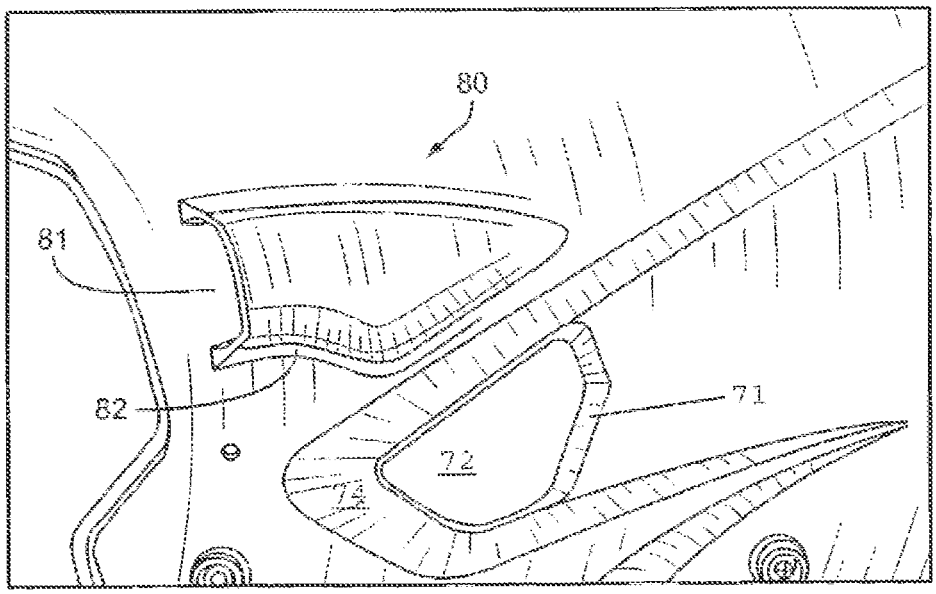
FIG. 12B is a side view of the attachment assembly of FIG. 12A.
Figure 12C:
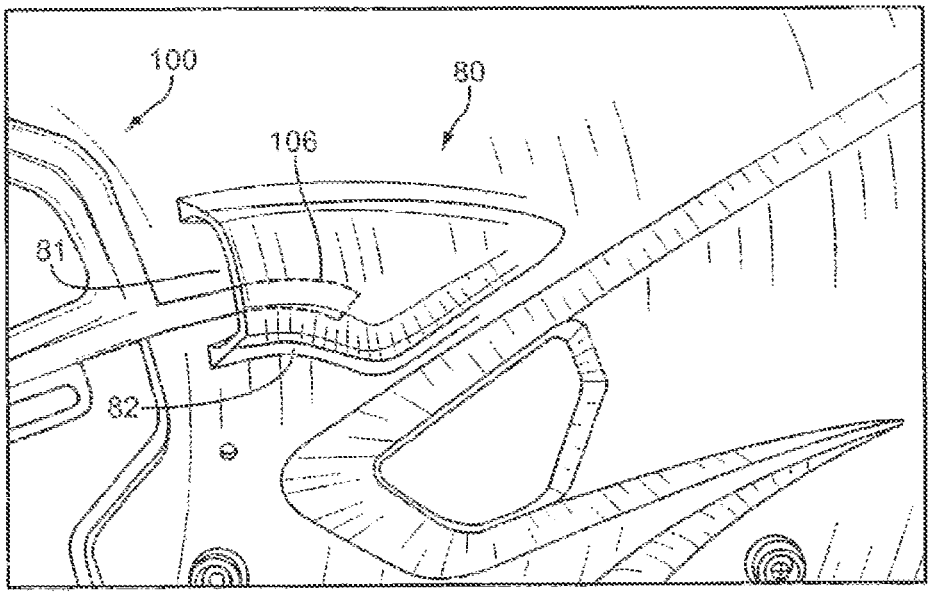
FIG. 12C is a cross sectional view of the attachment assembly of FIG. 12A.
Figure 13A:
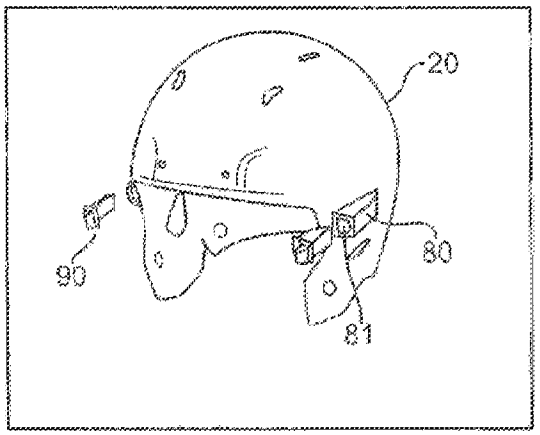
FIGS. 13A-13E are illustrations of a method of attaching an embodiment of the faceguard to the helmet of FIGS. 2A-2C in accordance with the present invention.
Figure 13B:
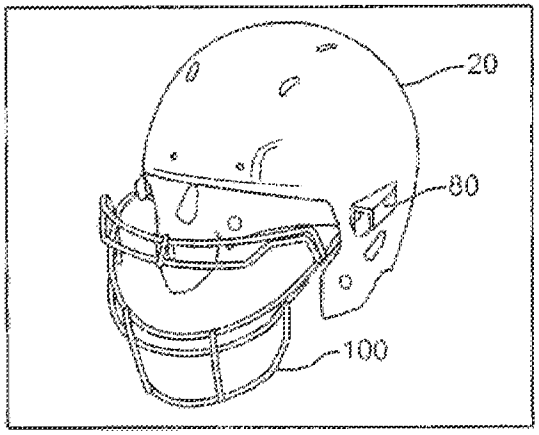
Figure 13C:
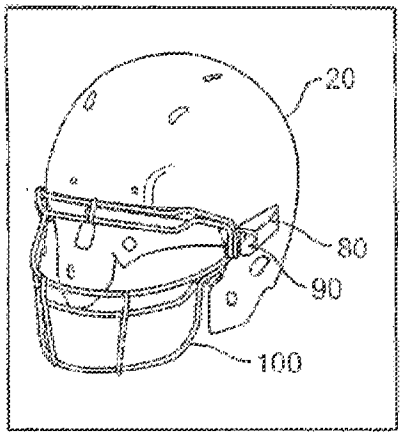
Figure 13D:
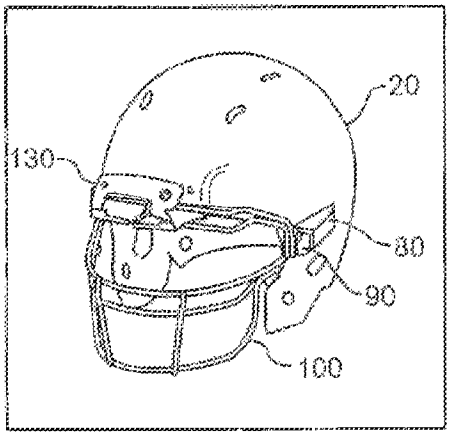
Figure 13E:
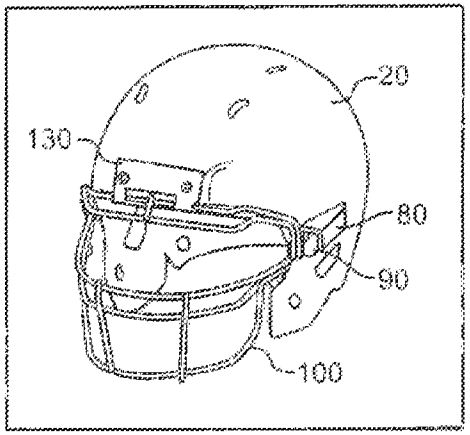

Referring back to FIG. 2A, the helmet 10 also includes two attachment assemblies 80 affixed to either side 21, 22 of the shell 20. Each attachment assembly 80 defines an opening 81, as shown by FIG. 12A. As shown by FIG. 12B, the attachment assembly 80 has a bottom edge 82 with a slight downwardly curved arc. Each attachment assembly 80 is configured to receive a corresponding curved wire segment 106 of the faceguard 100. FIG. 12C provides a cross sectional view of each attachment assembly 80 and demonstrates how a curved wire segment 106 interact and engages with the bottom edge 82 of the attachment assembly 80 such that removal of the faceguard 100 is prevented when an upward force in the direction of the top portion 30 of the shell 20 is applied to the faceguard 100. In addition, this engagement of the curved wire segment 106 and the attachment assembly 80 also occurs when the faceguard 100 is pulled outward from the shell 20.

Figure 2C:
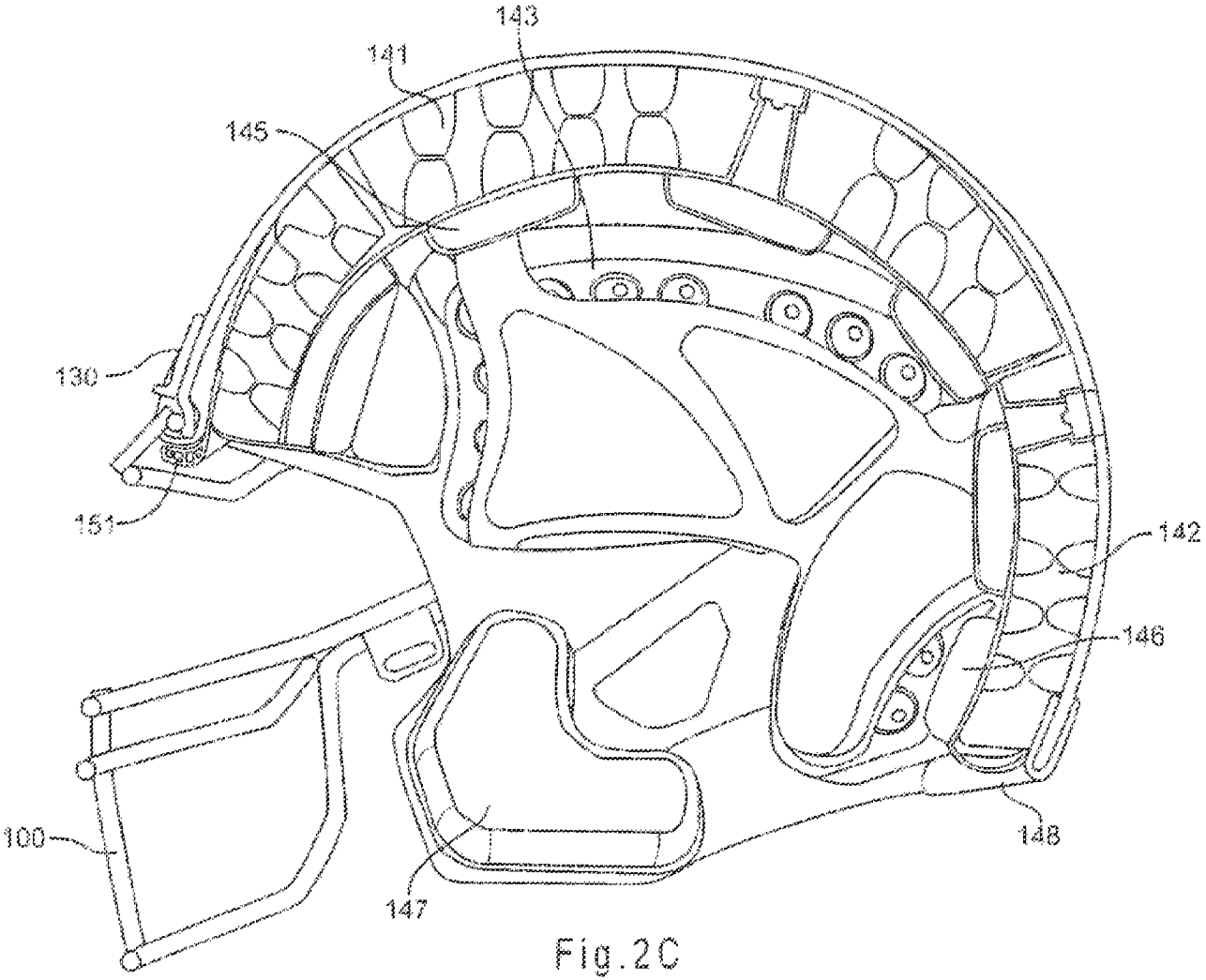
FIG. 2C is a side cross section on line A-A of FIG. 2A showing the inner surface of the helmet of FIG. 2A.
Figure 3:
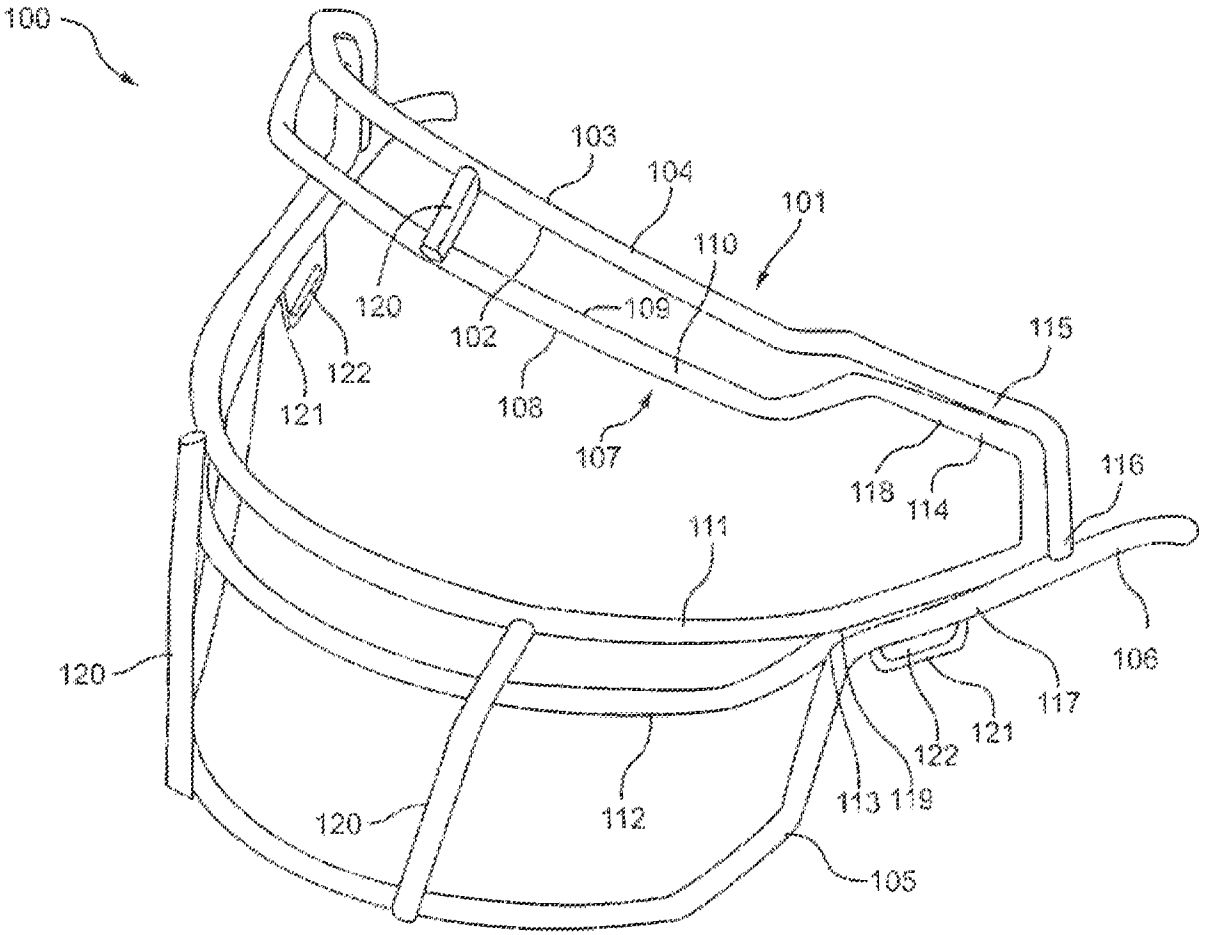
FIG. 3 is a perspective view of an embodiment of a faceguard to be used with the helmet of FIGS. 2A-2C in accordance with the present invention.

As shown in FIGS. 2A-2C, an impact stop element 90 is fitted in each opening of the attachment assemblies 80. Referring now to FIG. 7, the impact absorbing stop 90 includes a front end 91 and a back end 92. The impact absorbing stop 90 is composed of deformable material. The deformable material is preferably polyurethane or vulcanized rubber. Further, the surface of the impact absorbing stop 90 may include a pebbling texture to promote higher frictional engagement of the impact absorbing stop 90 with the opening 81 of the attachment assembly 80. The impact absorbing stop 90 may have a length of about 2.388 inches and a width of about 1.135 inches. An inside surface 93 of the impact absorbing stop 90 includes an indentation 94. When the impact stop element 90 is placed in the opening 81 of the attachment assembly 80, a closed channel is created in order to receive the curved wire segment 106 of the faceguard 100. The closed channel guides the curved wire segment 106 along the bottom edge of the opening 81 as shown in FIG. 12C.

During use, each attachment assembly 80 has a corresponding impact absorbing stop 90 inserted in the opening 81 prior to insertion of the curved wire segment 106 therein. When a force is applied to the faceguard 100 in the direction of the top portion 30 of the shell 20, the top portion 104 of the faceguard 100 pivots about a clamping mechanism 130, discussed in further detail below, and the curved wire segments 106 rotate in an upward direction and engage with the inner surface 93 of the impact absorbing stop 90. The impact absorbing stop 90 compresses as the force is applied to the faceguard 100 as described above and dissipates the energy created by the applied force. Further, the impact absorbing stop 90 acts to hold the faceguard 100 securely to the shell 20 as the wearer of the helmet 10 participates in the game. The curved wire segments 106 are placed in the closed channel created by the inside surface 93 of the impact absorbing stop 90 and the curved bottom edge 82. Thus, the curved wire segments 106 are sandwiched between the impact absorbing stop 90 and the attachment assembly 80, and lateral movement of the faceguard 100 in a direction away from the shell 20 is prevented.

Figure 9A:
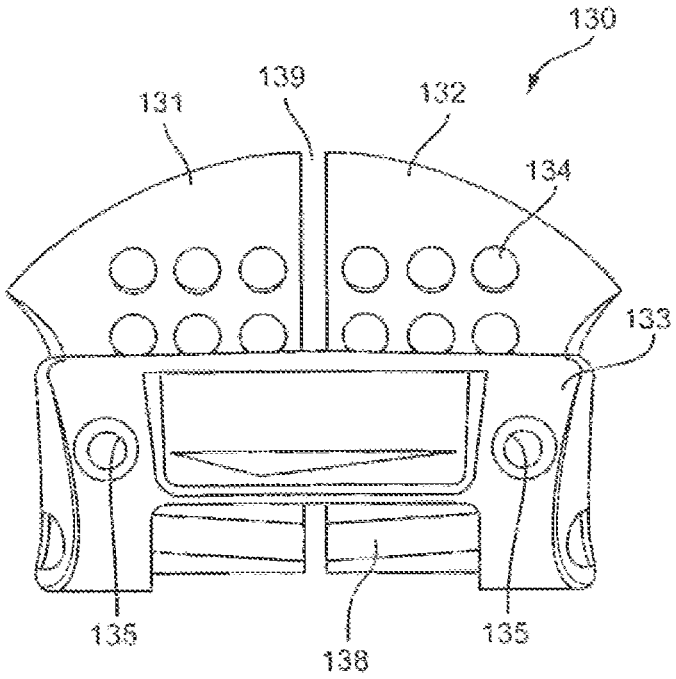
FIG. 9A is a front view of an embodiment of a clamping mechanism to be used with the helmet of FIGS. 2A-2C in accordance with the present invention.
Figure 9B:
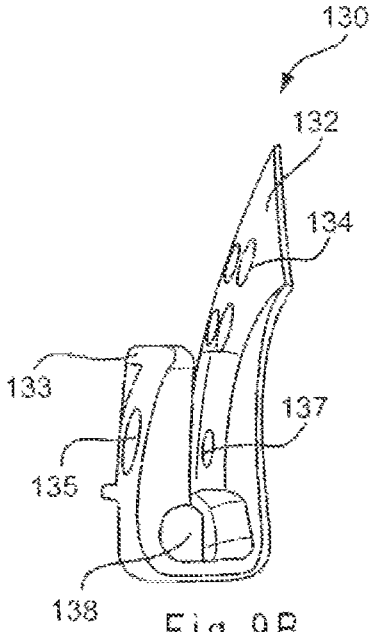
FIG. 9B is a side view of the clamping mechanism in FIG. 9A.

Referring to FIGS. 2C and 9A and 9B, the helmet 10 also includes a clamping mechanism 130 removably attached to the front edge 50 of the shell 20 of the helmet 10. The clamping mechanism 130 allows for attachment of the faceguard 100 to the front edge 50 of the shell 20. Further, the clamping mechanism 130 acts as a pivot point for the faceguard 100 when the faceguard 100 is impacted by forces throughout the game of football. As shown in FIGS. 9A and 9B, the clamping mechanism 130 has a U-shaped configuration with two legs 131 and 132, and a cross element 133. During attachment, the front edge 50 of the shell 20 is inserted into a groove 138 defined between the cross-element 133 and the legs 131 and 132. A plurality of apertures 134 are disposed through the legs 131 and 132. The legs 131 and 132 are configured to engage with an inner surface of the top portion 30 of the shell 20.

Preferably, the edges of the legs 131 and 132 are configured to coincide with the shape of the corrugated channel 60. The cross element 133 is attached to the legs 131 and 132. The cross element 133 is configured to fit over the front edge 50 of the shell 20. Preferably, as shown by FIG. 9A, the cross element 133 fits over the front edge 50 of the shell 20 and engages the outer surface of the corrugated channel 60. A pair of apertures 135 are disposed through the cross element 133 and each aperture 135 coincides with a pocket 137 on each leg 131 and leg 122.

As shown in FIGS. 9A and 9B, the groove 138 of the clamping mechanism 130 is defined by the lower ends of the legs 131 and 132 and a lower end of the cross element 133. The groove 138 is configured to receive a top portion of the first wire assembly 101 of the faceguard 100. A slit 139 is provided between legs 131 and 132. This slit 139 allows the clamping mechanism 130 to be fitted onto the faceguard 100 without interference from the vertical wire segment 120 that interconnects the first 101 and second 107 wire assemblies of the faceguard 100. In operation, the groove 138 of the clamping mechanism 130 engages the top portion 104 of the first wire assembly 101 of the faceguard 100. The clamping mechanism 130 is placed about the front edge 50 of the shell 20 such that the legs 131 and 132 to engage the inner surface of the corrugated channel 60 and the cross section 133 to engage the outer surface of the corrugated channel 60.

Referring back to FIG. 2A, screw mechanisms 136 are placed through the apertures 135 disposed in the cross element 133, corresponding apertures in the top portion 30 of the shell 20, and corresponding apertures 134 in legs 131 and 132 in order to attach the clamping mechanism 130 to the front end 30 of the shell 20. Each screw mechanism 136 may include any mechanism known to one of ordinary skill in the art. Preferably, each screw mechanism 136 includes a t-nut and screw combination. When the clamping mechanism 130 is attached to the front edge 50 of the shell 20 via the screw mechanisms 136, the top portion 104 of the first wire assembly 101 of the faceguard 100 is positioned between the corrugated channel 60 and the clamping mechanism 130. Preferably, this placement allows the top portion 104 of the first wire assembly 101 to make direct contact with the top portion 30 of the shell 20. More specifically, any part of the top portion 104 of the first wire assembly 101 is separated from the front edge 50 by an amount ranging from 0.000 inches (direct contact) to less than about 0.125 inches. A slit 139 is provided between legs 131 and 132. This slit 139 allows the clamping mechanism 130 to be fitted onto the faceguard 100 without interference from the vertical wire segment 120 that interconnects the first 101 and second 107 wire assemblies of the faceguard 100.

The helmet 10 further includes protective padding 140. The protective padding 130 engages an inner surface of the shell 20, The protective padding 140 provides added cushioning and protection to the head of the wearer of the helmet. As shown by FIGS. 1A-1C, 2A-2C, and 9A-9D, the protective padding 140 includes multiple pieces. Referring to FIG. 1C, a front crown padding 141 is provided and is configured to engage interior surfaces of the top portion 30 of the shell 20.

Figure 10A:
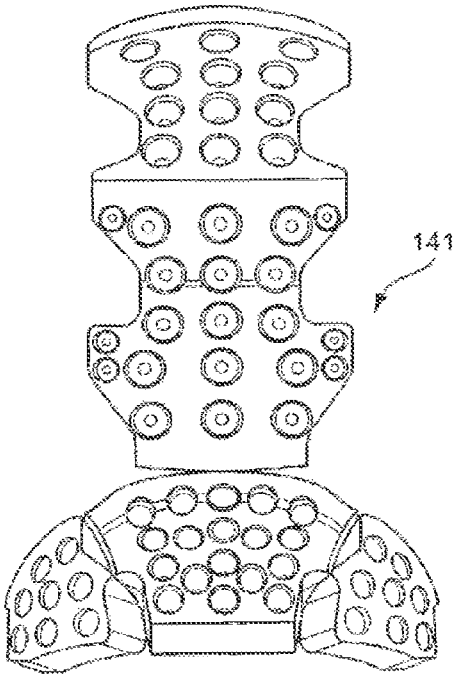
FIGS. 10A-10D are various embodiments of protective padding for use with the shell of FIGS. 1A-1C and the helmet of FIGS. 2A-2C in accordance with the present invention.
Figure 10B:
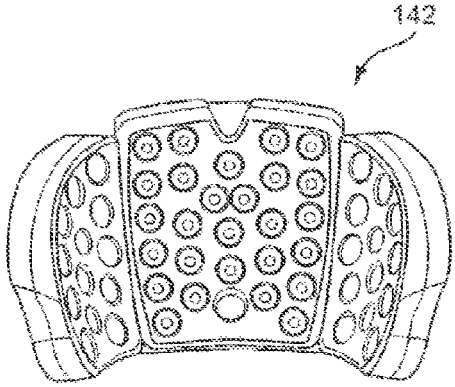
Figure 10C:
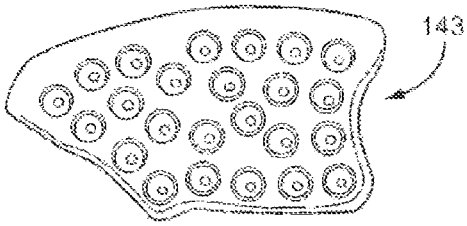
Figure 10D:
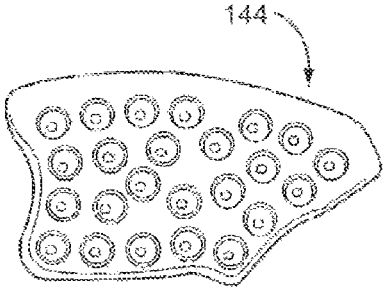
Figure 11A:
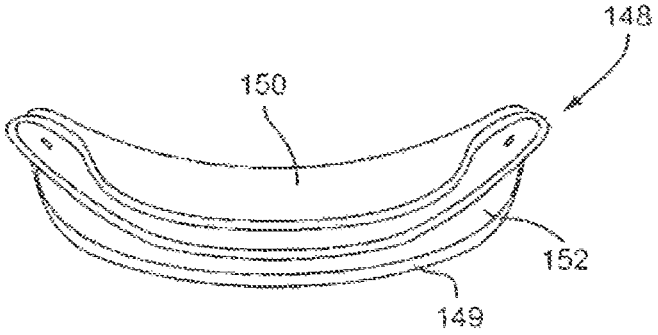
FIG. 11A is a front view of an embodiment of a back bumper for use with the helmet of FIGS. 2A-2C in accordance with the present invention.
Figure 11B:
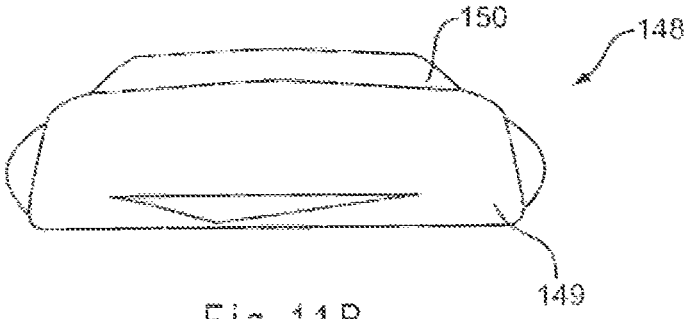
FIG. 11B is a side view of the back bumper of FIG. 11A.

A back padding 142 is configured to engage an interior surface of a back end of the bottom portion 40 of the shell 20. The right 21 and left 22 sides of the shell 20 may also include padding 143 and 144, respectively. The protective padding 130 may be manufactured from any suitable material known to one of ordinary skill in the art. One particular material that is suitable for the present invention is SKYDEX® padding manufactured by SKYDEX Technologies, Inc. of Centennial, Colo. Preferably, the protective padding 140 is preformed into a curved shape so that it better coincides with the interior surface of the shell 20. As shown in FIG. 2C, a front padding liner 145 and a back padding liner 146 are affixed to the protective padding 140. The sides 21 and 22 of the helmet 10 also include jaw pads 147 to protect the jaw of the wearer when a collision takes place. A back bumper 148, as shown in further detail in FIGS. 10A and 10B, may be affixed to a back end of the bottom portion 40 of the shell 20. The back bumper 148 has a U-shaped configuration with a front portion 149 and a back portion 150. An outer surface of the back bumper 148 is adapted to engage the back padding 142. An inner surface 152 of the back bumper 148 abuts the bottom portion 40 of the shell 20. As shown by FIG. 2C, a nose bumper 151 may be provided between the clamping mechanism 130 and the protective padding 140. The nose bumper 151 provides the added advantage of providing padding for the bridge of the nose of the wearer if the helmet 10 should become dislodged from the wearer's head and roll forward.

Referring now to FIG. 13A-13E, a method of attaching the faceguard to the shell of the helmet is provided. An impact stop element 90 is placed within an opening 81 of an attachment assembly 80 on the right 21 and left 22 sides of the shell 20. The curved wire segments 106 of the faceguard 100 are placed in the closed channel created by the indentation 94 of the impact absorbing stop 90 and the opening 81 of the attachment assembly 80. The faceguard 100 is placed at an angle in order for the curved wire segments 106 to fit properly within the attachment assembly 80. The curved wire segments 106 are fitted into the attachment assembly 80 as an external upward force in the direction of the top portion 30 of the shell 20 is applied to the faceguard 100 to place the faceguard 100 into the desired position to provide proper protection to the face of the wearer. The clamping mechanism 130 then engages the faceguard 100 by positioning the slit 139 of the clamping mechanism 130 through the vertical wire segment 120 connecting the top portion 104 of the first wire assembly 101 and top portion 110 of the second wire assembly 107 in order to place the top portion 104 of the faceguard 100 into the groove 138 of the clamping mechanism 130. The clamping mechanism 130 is then positioned over the top portion 30 of the shell 20 such that the legs 131 and 132 engage the inner surface of the top portion 30 of the shell 20, and the cross element 133 engages the outer surface of the top portion 30 of the shell 20. The clamping mechanism 130 is attached to the front end of the shell by the screw mechanism 136 comprising a t-nut and a screw. A t-nut is placed in the pockets 137 of the legs 131 and 132, respectively, and corresponding apertures on the top portion 30 of the shell 20. A screw is placed in each aperture 135 of the cross element 133 of the clamping mechanism 130, and corresponding apertures on the top surface 30 of the shell 20. Each screw engages with the corresponding t-nut in the pockets 137. The screws are tightened until the clamping mechanism 130 is secured to the front edge 50 of the shell 20. Thus, a segment of the top portion 104 of the faceguard 100 is in direct contact with the shell 20 of the helmet 10.

Figure 14A:
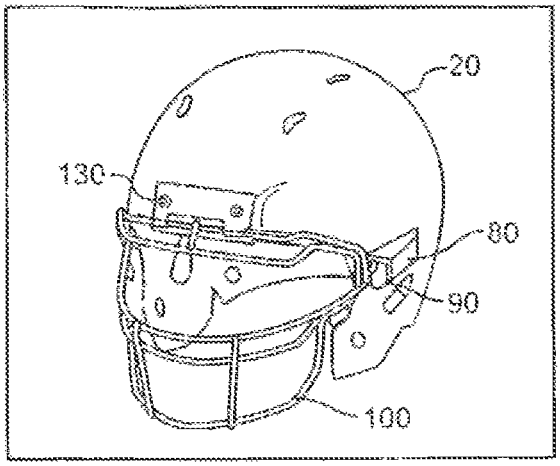
FIGS. 14A-14C are illustrations of a method of removing an embodiment of the faceguard from the helmet of FIGS. 2A-2C in accordance with the present invention.
Figure 14B:
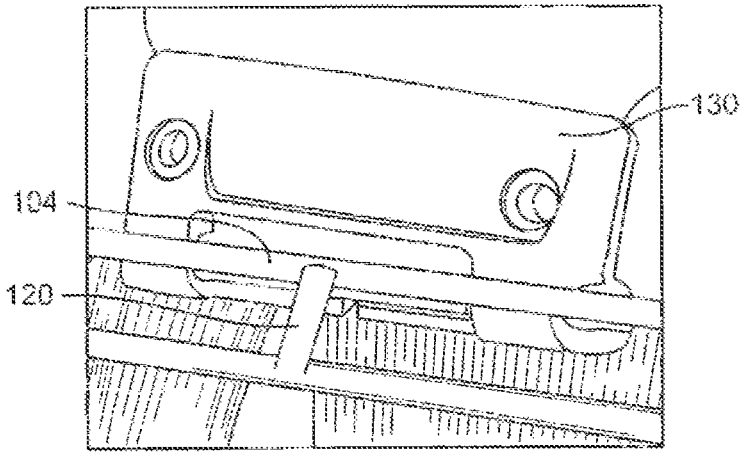
Figure 14C:
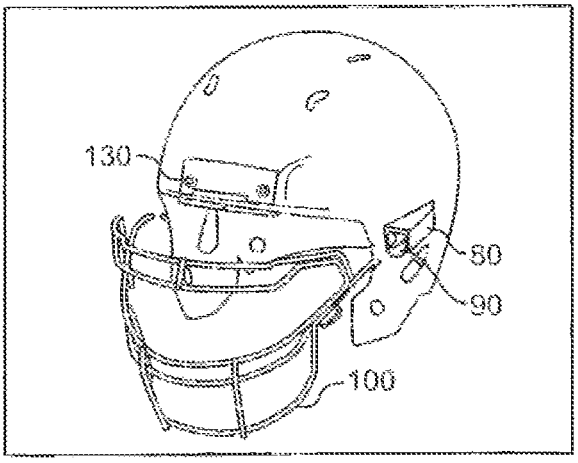

Referring now to FIG. 14A-14C, a method for removing the faceguard 100 is provided. The faceguard 100 is attached to the shell 20 of the helmet 10. The clamping mechanism 130 engages the top portion of the faceguard 100. To begin removal of the faceguard 100, the cross element 133 of the clamping mechanism 130 is cut in two places above the top portion of the faceguard 100 on the right and left side of the cross element 133, respectively. The cross element 133 is also cut in corresponding places below the top portion of the faceguard 100. The loose section of the cross element 133 is removed. The space created by cutting the cross element 133 of the clamping mechanism should be large enough so that the top portion of the faceguard 100 may be easily removed through the space. A person removing the faceguard 100 does so by pulling the faceguard 100 in a direction away from the front edge 50 of the shell 20 of the helmet 10. Further, the faceguard 100 is rotated in a direction away from the top portion of the shell 20. This rotation causes the curved wire segments 106 to disengage from the attachment assembly 80, which makes the faceguard 100 easy to remove from the shell 20.

The method of attaching the faceguard to the shell of the helmet and the method of removing the faceguard from the shell of the helmet would work in a similar manner for faceguards 200, 300, and 400 of FIGS. 4, 5, and 6, respectively, when attached to the shell 20 of FIGS. 1A-1C via the clamping mechanism 130.

It is therefore intended that the foregoing detailed description be regarded as illustrative rather than limiting, and that it be understood that it is the following claims, including all equivalents, that are intended to define the spirit and scope of this invention.

What is claimed is:

1. A football helmet with earhole grips, comprising:

a shell configured to fit about a head of a wearer of the helmet, the shell comprising:

an inner side of the shell and an outer side of the shell;

a top portion and a bottom portion, the top and bottom portions being areas of a unitary shell;

the top portion having a front area positioned for protecting a wearer's forehead comprising a front edge, the top portion also comprising a top area positioned for protecting a top of a wearer's head;

a bottom portion adjoining the top portion, the bottom portion of the shell comprising a rear portion positioned to cover the back of a wearer's head and two side portions positioned to cover the sides of a wearer's head including the ears, the bottom portion containing a pair of earholes on respective opposite side portions, each earhole positioned to be near a wearer's ears;

a faceguard comprising a faceguard assembly formed in a substantially closed loop, wherein a top portion of the faceguard assembly overlies the front area of the shell, the faceguard projecting away from the side portions of the shell and positioned to protect a wearer's face;

a plurality of attachment means attaching the faceguard assembly to the front area and the side portions of the shell;

a means for attaching a chin strap and a chin pad to the shell so that the chin pad can be positioned at a user's chin;

wherein each earhole comprises an opening in the shell and exactly five earhole edges surrounding and defining the opening in the shell on the sides of the opening; and each side portion has exactly three sloped banks descending from the surface of the shell to meet the earhole opening.

2. A football helmet according to claim 1, the football helmet further comprising a generally U-shaped clamping mechanism fixing the faceguard to the front area shell, the clamping mechanism comprising a bottom groove at a bottom of a U-shape for engaging the faceguard, the U-shaped clamping mechanism comprising at least two opposing arms extending away from the bottom of the U-shape, the U-shaped clamping mechanism comprising at least one aperture through each opposing arm, the apertures being positioned on the arms so that the apertures on opposite arms can be axially aligned;

wherein the faceguard assembly is fixed to the raised central channel of the shell by a plurality of screw mechanisms, each screw mechanism passing through axially aligned apertures on two opposite arms of a U-shape clamping mechanism, and also passing through an aperture through the raised central channel at the front area of the shell, wherein each screw mechanism comprises a nut at the inner side of the shell, the nut being positioned at the depression in the inner side of the shell;

wherein a portion of the central channel is at the front area of the shell, and wherein the at least one clamping mechanism is fixed to the shell at the central channel in the front area.

3. The football helmet of claim 1, further comprising a plurality of elongated vent openings on each side of the raised central channel, the vent openings being spaced from each other on each side of the channel and being elongated, from front to back, along the helmet shell.

4. The football helmet of claim 2, comprising four apertures through U-shaped clamping mechanism arms, and comprising two apertures through the raised central channel at the front area of the shell;

wherein each of two screws is positioned axially through two apertures through clamping mechanism arms and through one aperture in the raised central channel at the front area of the shell, and wherein each of the two screws is also engaged to a nut at the inner side of the shell; and wherein each nut is in the depression in the inner side of the shell in a space between the shell and protective padding in the shell.

5. The football helmet of claim 1, further comprising protective padding on the inner side of the shell, the padding being positioned so as not to block the earhole.

6. The football helmet of claim 1, wherein the bottom portion of the shell defines a first side edge that is integral with a first end of the front edge of the top portion; and a second side edge of the bottom portion that is integral with a second end of the front edge on the top portion, wherein the front edge, first side edge, and second side edge define a segment of a circumference of the shell, and wherein the earholes on respective side portions of the bottom portion are each positioned rearwardly of the respective first and second side edges.

7. The football helmet of claim 1, wherein in each side portion exactly two of the exactly three sloped banks extend past each earhole.

8. The football helmet of claim 1, wherein in each side portion exactly two of the sloped banks extend past each earhole toward the rear portion.

9. The football helmet of claim 1, wherein each of said sloped banks abuts one earhole edge.

10. The football helmet of claim 1, wherein in each side portion exactly two earhole edges are not abutted by a sloped bank.

* * * * *